US007399405B2

(12) United States Patent
Matsuura

(10) Patent No.: US 7,399,405 B2
(45) **Date of Patent: *Jul. 15, 2008**

(54) METHOD AND APPARATUS FOR SEPARATING PETROLEUM

(75) Inventor: Kazuo Matsuura, Naruto (JP)

(73) Assignee: Ultrasound Brewery, Tokushima (JP)

( * ) Notice: Subject to any disclaimer, the term of this patent is extended or adjusted under 35 U.S.C. 154(b) by 412 days.

This patent is subject to a terminal disclaimer.

(21) Appl. No.: 11/197,333

(22) Filed: Aug. 5, 2005

(65) Prior Publication Data

US 2006/0027487 A1 Feb. 9, 2006

(30) Foreign Application Priority Data

Aug. 9, 2004 (JP) ..... 2004-232771
Feb. 18, 2005 (JP) ..... 2005-043275

(51) Int. Cl.
*C10G 31/00* (2006.01)
*B06B 1/00* (2006.01)

(52) U.S. Cl. ..... 208/308; 208/370; 422/127; 422/128; 429/4

(58) Field of Classification Search ..... 208/308, 208/370; 422/127, 128; 429/4
See application file for complete search history.

(56) References Cited

U.S. PATENT DOCUMENTS

2006/0032935 A1* 2/2006 Matsuura ..... 239/9

FOREIGN PATENT DOCUMENTS

JP 11-80754 3/1999

* cited by examiner

*Primary Examiner*—Glenn Caldarola
*Assistant Examiner*—Randy Boyer
(74) *Attorney, Agent, or Firm*—Wenderoth, Lind & Ponack, L.L.P.

(57) ABSTRACT

In the present invention, petroleum is separated into hydrocarbon mixtures having different components at an atomizing step and a collecting step. At the atomizing step, the petroleum is ultrasonically vibrated and is discharged and atomized in a state of an atomized fine particle floating in a carrier gas. At this step, the petroleum is separated into a mixed fluid containing the atomized fine particle and the carrier gas and residual petroleum which is not atomized. At the collecting step, the hydrocarbon mixture is separated and collected from the mixed fluid obtained at the collecting step. In the separating method, the petroleum is separated into the residual petroleum and the mixed fluid at the atomizing step, and the mixed fluid is collected at the collecting step so that the petroleum is separated into hydrocarbon mixtures having different components.

17 Claims, 20 Drawing Sheets

METHOD AND APPARATUS FOR SEPARATING PETROLEUM

BACKGROUND OF THE INVENTION

1. Field of the Invention

The present invention relates to a method and apparatus for separating petroleum which can efficiently separate a crude oil and refine gasoline or the like.

2. Description of the Related Art

There has been developed a method of distilling and refining a crude oil (see Japanese Unexamined Patent Publication (KOKAI) No. Hei 11-80754). In a method of separating a crude oil described in this publication, a crude oil is subjected to an atmospheric distillation and is thus separated into hydrocarbon mixtures having different components such as a residual oil, a light oil, kerosene, naphtha, an LP gas and a soft gas. In this method, the crude oil is heated to be a vapor, the vapor is liquefied and separated into hydrocarbon mixtures having different components to be refined.

A method of distilling and separating a crude oil requires a thermal energy in a large amount in order to vaporize the crude oil. The reason is that the vaporization heat of the crude oil is very high. Moreover, there is also employed a method of distilling or refining petroleum and separating the petroleum into a specific hydrocarbon mixture. Also in this method, a high thermal energy is required for vaporizing the petroleum into a vapor.

In a distilling process described in the aforementioned publication according to the prior art, a difference in a thermodynamic vapor pressure is utilized and a difference in a vaporization speed into a vapor phase at a certain pressure and temperature is thus used. This technique basically utilizes a vapor-liquid equilibrium relationship among large number of components. More specifically, a difference between the moving speeds of substances under a vapor saturation on the vapor phase side is utilized to obtain a driving force for a separation. As is easily imagined, however, the moving speed of the substance is increased when a difference in a vapor-liquid concentration is increased. From a viewpoint of a vapor-liquid equilibrium, the vapor phase side is filled with the vapor of a target substance. For this reason, originally, a speed at which the target substance can be moved from a liquid phase to the vapor phase is actually suppressed.

In the conventional distilling process, thus, the moving speed of a substance to be taken by an originally natural phenomenon is restricted. For this reason, a energy consumed by the whole apparatus is unnecessarily increased. In addition, the distilling process uses a boiler as a heat source. For such occasions, a very long time is required for warming up a whole huge distilling tower. In order to pursue economy, consequently, an operation is inevitably carried out for a long period of time to reduce the rate of occupation of a start-up time.

Moreover, the boiler is used as the heat source. For this reason, a nitride compound, a sulfur compound, a population substance of a floating granular substance and the like in a heavy oil to be a supplied substance are discharged in a large amount into the air after oxidation, and the discharge of carbon dioxide to be a warming substance becomes a social problem. Thus, the distilling technique for supporting a modern society has a large number of problems.

In order to atomize a solution, moreover, a method utilizing a spray nozzle or a centrifugal force is used in some cases. However, the method is not suitable for a separation process for the following reasons.

(1) A particle size is large;

(2) A higher energy than that in an ultrasonic atomizing method is required for obtaining an atomized fine particle having a small particle size;

(3) In a method of causing compressed air to collide with a liquid to be atomized, a temperature is dropped in an adiabatic expansion when the compressed air is released under an atmospheric pressure by using a compressor or the like. For this reason, a separation phenomenon utilizing an atmospheric heat cannot be expected in an atomizing portion.

The present invention has been developed in order to solve the drawbacks of the conventional methods. An important object of the present invention is to provide a method and apparatus for separating petroleum which can efficiently separate petroleum into hydrocarbon mixtures having different components by a small energy consumption.

SUMMARY OF THE INVENTION

A method of separating petroleum according to the present invention separates petroleum into hydrocarbon mixtures having different components. The method of separating petroleum comprises the steps of ultrasonically vibrating the petroleum to discharge and atomize the petroleum in a state of an atomized fine particle floating in a carrier gas, and carrying out a separation into a mixed fluid containing the atomized fine particle and the carrier gas and residual petroleum which is not atomized, and separating and collecting the hydrocarbon mixture from the mixed fluid obtained at the atomizing step. In the separating method, the petroleum is separated into the residual petroleum and the mixed fluid at the atomizing step, and the mixed fluid is collected at the collecting step to separate the petroleum into hydrocarbon mixtures having different components.

In the method described above, the petroleum is ultrasonically vibrated and is atomized by the vibration energy of an ultrasonic wave, and is discharged as the atomized fine particle floating in the carrier gas and is thus separated into the mixed fluid of the atomized fine particle and the air and the residual oil which is not atomized. The hydrocarbon mixture in the mixed fluid is separated from the carrier gas and is thus collected. More specifically, untreated petroleum is changed into the atomized fine particle floating in the carrier gas to obtain the mixed fluid, and is separated into the petroleum separated from the mixed fluid and the petroleum which is not changed into the atomized fine particle but remains. In comparison of the separated petroleum with the residual petroleum, the hydrocarbon mixtures having different components are obtained. The petroleum is a hydrocarbon mixture containing a plurality of hydrocarbons expressed in a general formula of $C_nH_m$. In other words, the hydrocarbon mixture contains a plurality of hydrocarbons having different numbers of carbons (n). In comparison of the separated petroleum with the residual petroleum, different hydrocarbons are contained. The separated petroleum has a large content of the hydrocarbon having a small number of carbons (n) and the residual petroleum has a large content of the hydrocarbon having a large number of carbons (n). As compared with the hydrocarbon having a large number of carbons (n), the hydrocarbon having a small number of carbons (n) is atomized into the atomized fine particle more easily. Consequently, the separated petroleum has a large content of the hydrocarbon having a small number of carbons (n). To the contrary, the hydrocarbon having a large number of carbons (n) is atomized into the atomized fine particle with more difficulty as compared with the hydrocarbon having a small number of carbons (n). Consequently, the residual petroleum has a large content of the hydrocarbon having a large number of carbons (n).

In the method described above, moreover, it is also possible to carry out a separation into hydrocarbon mixtures having different components at the step of collecting the hydrocarbon mixture from the mixed fluid. In a method and apparatus for gradually cooling the mixed fluid to a lower temperature, and separating the mixed fluid into the hydrocarbon mixture, the hydrocarbon mixture having a large number of carbons (n) is collected earlier and the hydrocarbon mixture having a small number of carbons (n) is collected later. The reason is that the hydrocarbon mixture having a large number of carbons (n) is liquefied more easily than the hydrocarbon mixture having a small number of carbons (n). Accordingly, it is also possible to separate the mixed fluid into the hydrocarbon mixtures having different numbers of carbons (n) at the step of separating the hydrocarbon mixture from the mixed fluid.

In the method described above, the petroleum is atomized as the atomized fine particle in the carrier gas by the ultrasonic vibration and the atomized fine particle is collected and is separated into the hydrocarbon mixtures having different components. For this reason, it is not necessary to apply a high vaporization heat in order to vaporize the petroleum differently from the conventional art in which the petroleum is separated into the hydrocarbon mixtures by distillation. Consequently, it is possible to efficiently separate the petroleum into the hydrocarbon mixtures having different components by a small energy consumption. The petroleum can be efficiently atomized into the atomized fine particle by the ultrasonic vibration for the following reason. The ultrasonic vibration takes a high nonequilibrium degree of a target substance between a gas and a liquid, so that the ultrasonic vibration maintains a high moving speed of the substance. Furthermore, in case of the petroleum to be a mixture type of complicated substances, it is also necessary to pay attention to an intermolecular interaction for each substance. In the distillation, the whole petroleum is heated. A thermal energy gives a kinetic energy to molecules while breaking the intermolecular intersection. At this time, a difference for each molecular type is not made and a force for giving the energy to the molecule is equivalent. In such a situation, an energy level is increased for both substances having high and low vapor pressures in the same manner. Accordingly, the separation proceeds in a state in which the moving speed of the substance is increased for every molecular species.

On the other hand, the atomization to be carried out by the ultrasonic vibration utilizes a difference in the moving speed of the substance with a low energy level. There is utilized a difference in the bond energy of a molecule obtained by subtracting the thermal kinetic energy of the molecule from the vaporization energy of the substance (an intermolecular force solubility parameter: a square of SP). More specifically, in a solution atomized at a low temperature which is equal to or lower than a boiling point by the action of the ultrasonic vibration, the molecule is localized on a molecular level. A substance having large SP easily remains on the residual petroleum side and a substance having small SP is easily changed into an atomized fine particle. By utilizing the difference in the bond energy between the molecules, a separation phenomenon is caused at the temperature which is equal to or lower than the boiling point. Furthermore, it is not necessary to break the bond of the same molecules on the molecular level. If a group of molecules A and that of molecules B can be exactly classified when sieving out the molecules A and B, a small energy for the separation is sufficient. In the distillation, this cannot be carried out. All of the intermolecular forces are once cut by a thermal energy. In the distillation, the bond of the molecules A and that of the molecules B which are broken are reconstituted by cooling. In this respect, the greatest wastefulness is caused in the distillation process.

In the method of separating petroleum according to the present invention, it is possible to use a crude oil for the petroleum to be separated, and to separate gasoline, a light oil and kerosene from the crude oil. In the method of separating petroleum according to the present invention, moreover, it is possible to use the gasoline for the petroleum to be separated and to refine the gasoline. In the separating method, furthermore, it is possible to separate the gasoline into residual petroleum and a mixed fluid at the atomizing step, and to reduce a reid vapor pressure of the gasoline to be the residual petroleum. In the method of separating petroleum according to the present invention, moreover, it is possible to heat and atomize the petroleum at the atomizing step. In the method of separating petroleum according to the present invention, furthermore, it is possible to set the carrier gas to be air.

In the method of separating the gasoline into the residual petroleum and the mixed fluid to reduce the reid vapor pressure of the gasoline to be the residual petroleum at the atomizing step, there is a feature that the vaporizing property of the gasoline is suppressed and a fuel vaporization gas can be thus prevented from being generated. In general, the gasoline has a high vaporizing property, and furthermore, the amount of the vaporization of the gasoline is increased with a rise in an atmospheric temperature, the temperature of an engine or the like in a gasoline automobile. A part of the gasoline which is vaporized is discharged as a fuel vaporization gas from an automobile or a gas station to the air. The fuel vaporization gas is a precursor such as a floating granular substance (SPM) or photochemical oxidant (OX), and it is very important to reduce the generation of the fuel vaporization gas in respect of an environment. A character for the vaporizing property of the gasoline includes a reid vapor pressure (RVP), and the gasoline is vaporized more easily when the RVP is higher. In the separating method according to claim 4 of the present invention, at the atomizing step, the gasoline is separated into the residual petroleum and the mixed fluid so that a hydrocarbon mixture having a great vaporizing property can be separated to reduce the vaporizing property of the residual petroleum. More specifically, it is possible to reduce the reid vapor pressure of the gasoline to be separated as the residual petroleum. Thus, the gasoline having the reid vapor pressure reduced can lessen the generation of the fuel vaporization gas. Consequently, it is possible to reduce the fuel vaporization gas to be discharged into the air, and to obtain the effect of preventing an air pollution such as the photochemical oxidant from being caused.

An apparatus for separating petroleum according to the present invention separates the petroleum into hydrocarbon mixtures having different components. The apparatus for separating petroleum includes an atomizing device 100 for ultrasonically vibrating the petroleum and discharging and atomizing the petroleum in a state of an atomized fine particle floating in a carrier gas, and carrying out a separation into a mixed fluid containing the atomized fine particle and the carrier gas and residual petroleum which is not atomized, and a collecting device 200 for separating and collecting the hydrocarbon mixture from the mixed fluid obtained in the atomizing device 100. The separating device separates the petroleum into the residual petroleum and the mixed fluid by the atomizing device 100 and collects the mixed fluid by the collecting device 200, so that the separating device separates the petroleum into hydrocarbon mixtures having different components.

In the apparatus for separating petroleum according to the present invention, the atomizing device 100 can include an atomizing chamber 4 for supplying the petroleum and an atomizing machine 1 for atomizing the petroleum in the atomizing chamber 4 into the atomized fine particle by the ultrasonic vibration. In the apparatus for separating petroleum according to the present invention, the atomizing device 100 includes an ultrasonic vibrator 2, and the ultrasonic vibrator 2 can ultrasonically vibrate the petroleum and can atomize the petroleum into the atomized fine particle. In the apparatus for separating petroleum according to the present invention, furthermore, the collecting device 200 can coot the mixed fluid containing the atomized fine particle and the carrier gas, and collect the hydrocarbon mixture.

The above and further objects and features of the invention will be more fully apparent from the following detailed description with accompanying drawings.

DETAILED DESCRIPTION OF THE PREFERRED EMBODIMENTS

Figure 1:
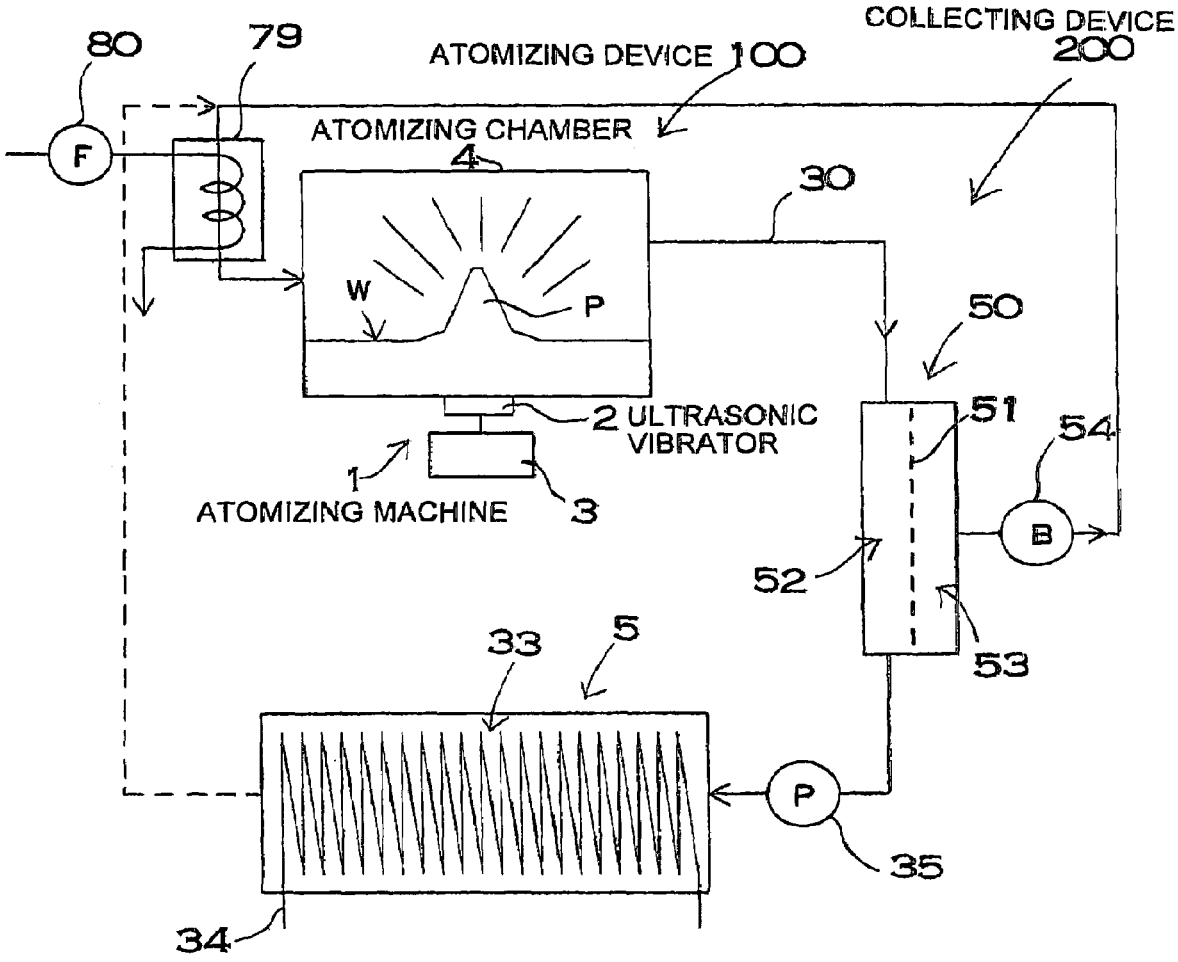
FIG. 1 is a schematic view showing a structure of an apparatus for separating petroleum according to an example of the present invention.

In a separating method according to the present invention, petroleum such as a crude oil or gasoline is atomized into an atomized fine particle and the atomized fine particle is then collected and separated into hydrocarbon mixtures having different components. By using a method and an apparatus according to the present invention, it is possible to separate the crude oil into hydrocarbon mixtures having different components such as a residual oil, a light oil, kerosene, naphtha, an LP gas and a soft gas. Moreover, it is possible to refine the naphtha, and separate the gasoline. Furthermore, it is possible to refine the gasoline, the light oil, the heavy oil or the like, and to separate and reform the hydrocarbon mixtures having different components.

When the petroleum is atomized into the atomized fine particle, the amounts of mixture of the hydrocarbon mixtures to be contained are different from each other for the atomized fine particle and the residual petroleum. The reason is that the hydrocarbon mixture having a small number of carbons (n) is easily atomized into the atomized fine particle and the hydrocarbon mixture having a large number of carbons (n) is atomized into the atomized fine particle with difficulty and is apt to remain as the residual petroleum. Accordingly, it is possible to collect the atomized fine particle from a mixture fluid and to separate the atomized fine particle into the hydrocarbon mixtures having different components. The hydrocarbon mixture separated from the mixed fluid mainly has a small number of carbons (n), and the hydrocarbon mixture of the residual petroleum mainly has a large number of carbons (n).

Also at a step of flocculating and collecting the atomized fine particle, it is possible to separate the hydrocarbon mixtures having different components. The reason is that the degree of flocculation and liquefaction is varied depending on the number of carbons (n) in the hydrocarbon mixture. The hydrocarbon mixture having a large number of carbons (n) is easily liquefied and is thus collected earlier, and the hydrocarbon mixture having a small number of carbons (n) is liquefied with difficulty and is thus collected later. In the case in which the gasoline, the light oil, the heavy oil or the like is to be reformed, the petroleum is separated into the residual petroleum and the atomized fine particle and the atomized fine particle is separated into the hydrocarbon mixtures having different components. In the case in which the crude oil is to be separated into the residual oil, the light oil, the kerosene, the naphtha, the LP gas, the soft gas or the like, moreover, it is separated into the hydrocarbon mixtures having different numbers of carbons (n) at the collecting step of the step of carrying out the atomization into the atomized fine particle.

In the present invention, the petroleum is ultrasonically vibrated and is thus atomized. A separating apparatus shown in FIGS. 1 to 4 comprises an atomizing device 100 and a collecting device 200. The atomizing device 100 includes an atomizing chamber 4 having a closed structure to which the petroleum is supplied, and an atomizing machine 1 for atomizing the petroleum in the atomizing chamber 4 into an atomized fine particle. The collecting device 200 includes an air separating machine 50 for separating air from a mixed fluid containing the atomized fine particle obtained in an atomizing chamber 1 and air, a collecting chamber 5 for separating and collecting a hydrocarbon mixture from the mixed fluid from which a part of the air is separated by the air separating machine 50, and a forcible delivering machine 35 for moving the mixed fluid.

The petroleum is supplied to the atomizing chamber 4 through a pump 10. The atomizing chamber 4 does not atomize the whole petroleum to be supplied into the atomized fine particle. The reason is that the hydrocarbon mixture contained in the petroleum collected into the collecting chamber 5 is the same as that of the petroleum supplied to the atomizing chamber 4 if the whole petroleum is atomized and collected into the collecting chamber 5. In a method and an apparatus which carry out a separation into petroleum containing hydrocarbon mixtures having different components at a step of atomizing the petroleum into a mixed fluid and separating the hydrocarbon mixture from the mixed fluid, the whole petroleum is atomized into the atomized fine particle and the atomized fine particle is separated into the hydrocarbon mixtures having different components.

The petroleum supplied to the atomizing chamber 4 is partially atomized into the atomized fine particle. Accordingly, the amount of the petroleum is decreased. In the lessened petroleum, the content of the hydrocarbon mixture to be easily atomized is reduced. For this reason, when the petroleum is not supplied to the atomizing chamber 4 but is continuously atomized into the atomized fine particle, the concentration of the hydrocarbon mixture to be easily atomized into the atomized fine particle is decreased. The hydrocarbon mixture to be easily atomized is changed into the atomized fine particle to be removed earlier. Consequently, the concentration of the hydrocarbon mixture to be easily atomized in the residual petroleum is decreased. By exchanging the petroleum in the atomizing chamber 4 with new one, it is possible to prevent a reduction in the concentration of the hydrocarbon mixture contained in the residual petroleum and atomized easily.

The atomizing chamber 4 exchanges the petroleum by a method of exchanging the petroleum with new one after the passage of a certain time, that is, a batch method. It is also possible to couple an undiluted solution reservoir 11 storing the petroleum to the atomizing chamber 4 through the pump 10, and to supply the petroleum from the undiluted solution reservoir 111 continuously. This apparatus can supply the petroleum from the undiluted solution reservoir 11 while discharging the residual petroleum in the atomizing chamber 4, and prevent a reduction in the concentration of the hydrocarbon mixture contained in the petroleum of the atomizing chamber 4 and atomized easily. As shown in an arrow B of FIG. 4, moreover, it is also possible to discharge the residual petroleum in the atomizing chamber 4 to an outside without a circulation into the undiluted solution reservoir 11, so that the apparatus prevents a reduction in the concentration of the hydrocarbon mixture contained in the undiluted reservoir 11 and atomized easily.

The petroleum in the atomizing chamber 4 is atomized into the atomized fine particle by the atomizing machine 1. The atomized fine particle thus obtained has a higher concentration of the hydrocarbon mixture which is atomized easily than that in the residual petroleum. By atomizing the petroleum into the atomized fine particle by the atomizing machine 1 to collect the atomized fine particle, accordingly, it is possible to efficiently separate petroleum having a large content of the hydrocarbon mixture which is atomized easily, that is, the hydrocarbon mixture having a small number of carbons (n).

Figure 5:
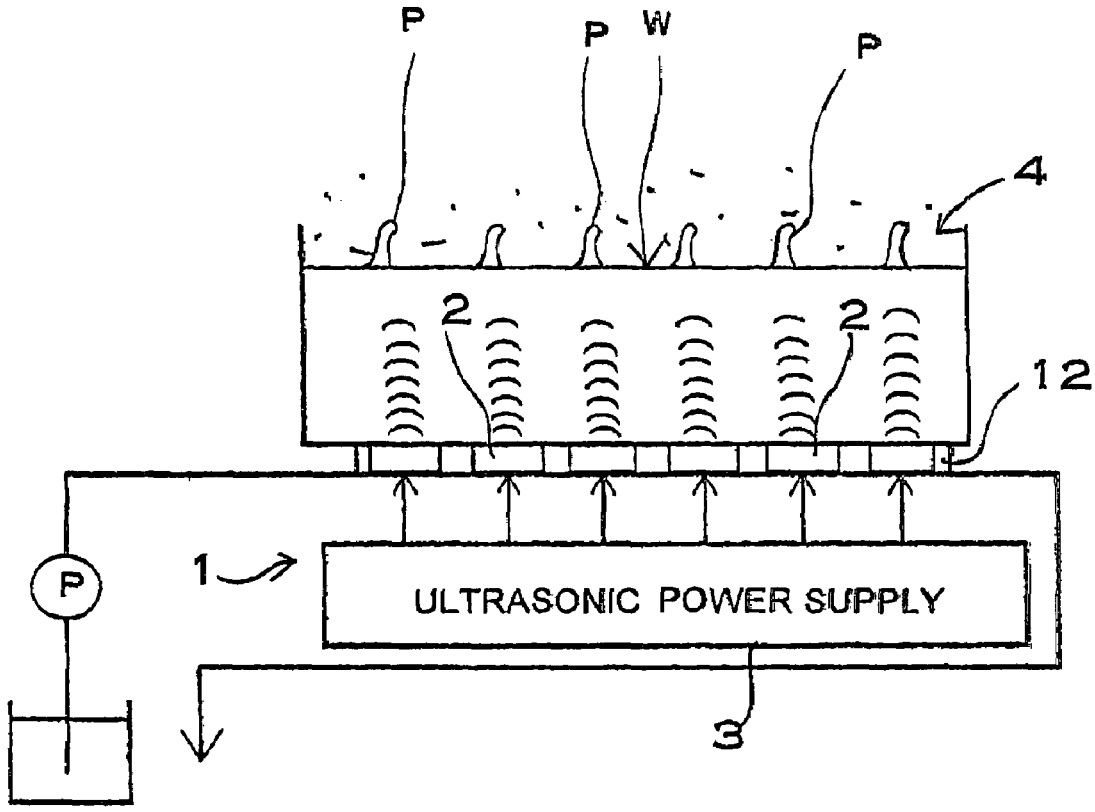
FIG. 5 is a schematic sectional view showing an example of an atomizing chamber and an atomizing machine.

The atomizing machine 1 includes a plurality of ultrasonic vibrators 2 and an ultrasonic power supply 3 for supplying a high frequency power to the ultrasonic vibrator 2. The atomizing machine 1 is preferably vibrated ultrasonically at a frequency of 1 MHz or more, and atomizes the petroleum. By using the atomizing machine 1, it is possible to atomize the petroleum into a very fine atomized particle. In the present invention, the vibration frequency of the ultrasonic vibration is not specified but can be set to be lower than 1 MHz The atomizing machine 1 for ultrasonically vibrating the petroleum scatters the petroleum, from a petroleum surface W, as the atomized fine particle of petroleum which is atomized more easily than the petroleum remaining in the atomizing chamber 4, that is, petroleum containing a large amount of hydrocarbon mixtures having a small number of carbons (n). When the petroleum is ultrasonically vibrated, a liquid column P is formed on the petroleum surface W so that the atomized fine particle is generated from the surface of the liquid column P. The atomizing machine 1 shown in FIG. 5 is provided with the ultrasonic vibrator 2 upward on the bottom of the atomizing chamber 4 filled with the petroleum. The ultrasonic vibrator 2 radiates an ultrasonic wave upward from the bottom toward the petroleum surface W, and ultrasonically vibrates the petroleum surface W, so that the ultrasonic vibrator 2 generates the liquid column P. The ultrasonic vibrator 2 radiates the ultrasonic wave in a vertical direction.

The atomizing machine 1 shown in the drawing includes a plurality of ultrasonic vibrators 2 and the ultrasonic power supply 3 for ultrasonically vibrating these ultrasonic vibrators 2. The ultrasonic vibrator 2 is fixed in a watertight structure to the bottom of the atomizing chamber 4. An apparatus in which the ultrasonic vibrators 2 ultrasonically vibrate the petroleum atomizes the petroleum into the atomized fine particle more efficiently.

Figure 6:
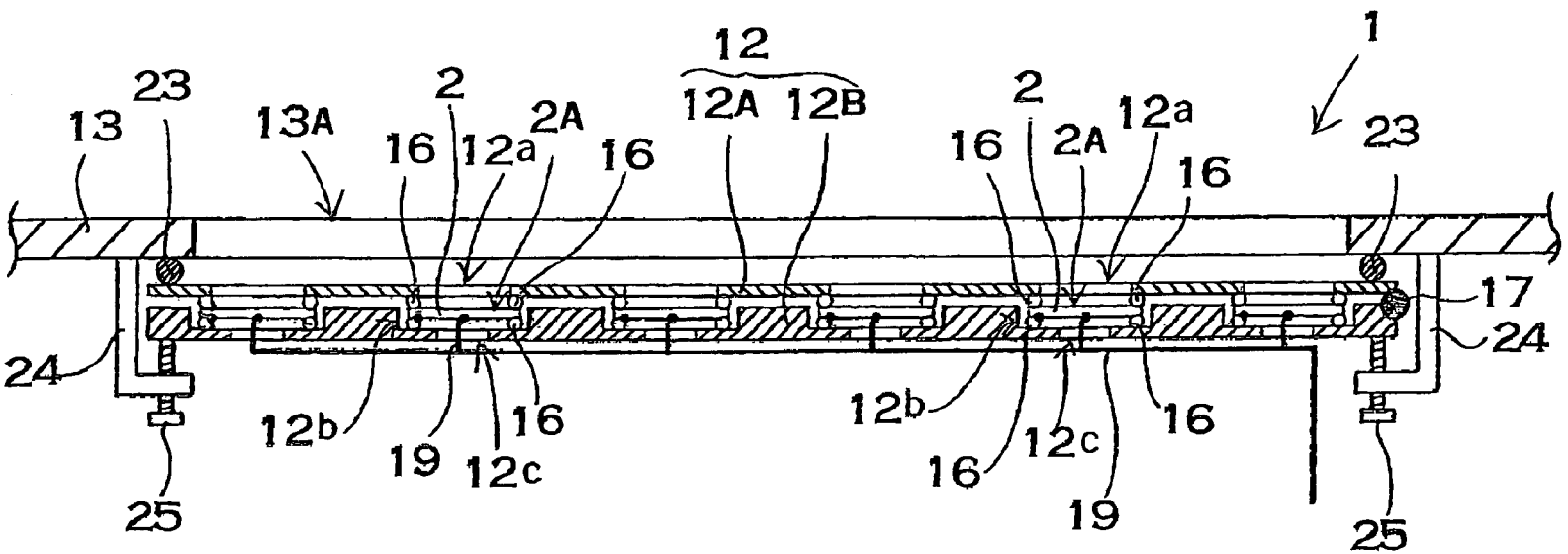
FIG. 6 is an enlarged sectional view showing an example of a coupling structure of an ultrasonic vibrator and a removable plate.
Figure 7:
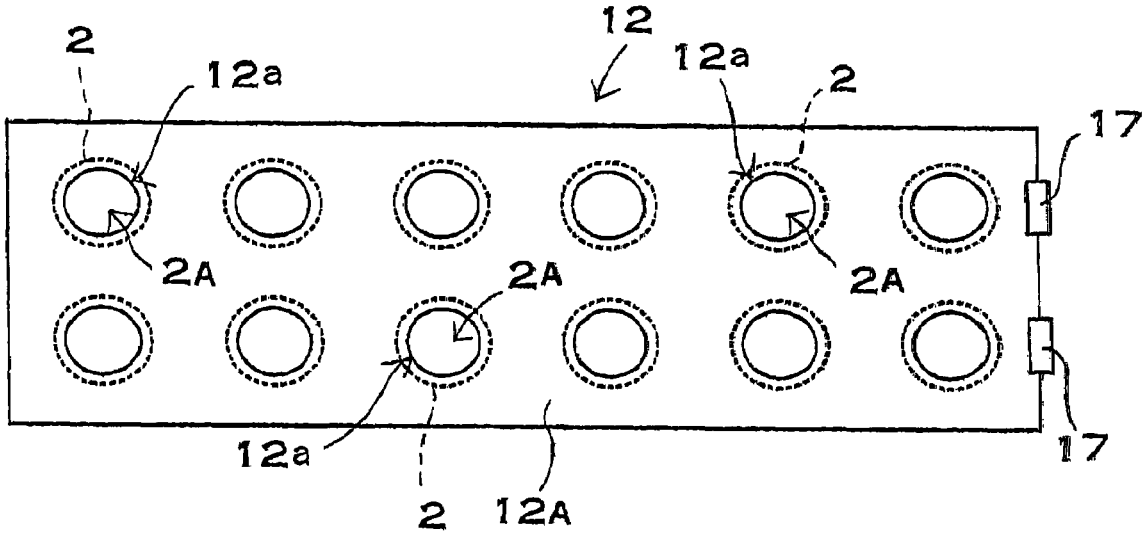
FIG. 7 is a plan view showing the removable plate illustrated in FIG. 6.
Figure 8:
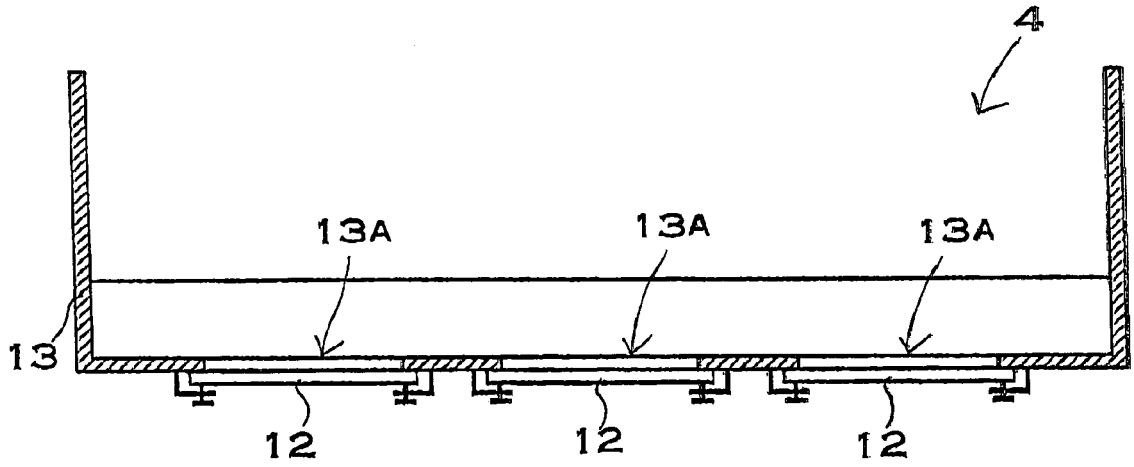
FIG. 8 is a sectional view showing a state in which the removable plate is attached to the atomizing chamber.
Figure 9:
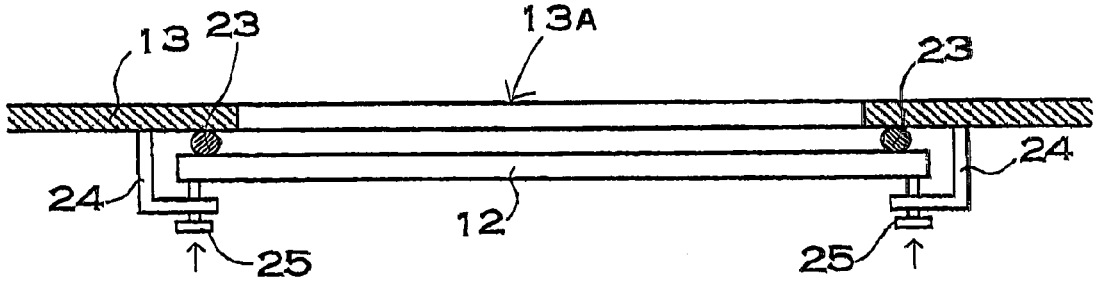
FIG. 9 is an enlarged sectional view showing the coupling structure of the removable plate and the atomizing chamber illustrated in FIG. 8.

The ultrasonic vibratos 2 are fixed to the removable plate 12 in a waterproof structure as shown in FIGS. 6 and 7. The removable plate 12 fixing the ultrasonic vibrators 2 is attached to a casing 13 in the atomizing chamber 4 so as to be removable in the waterproof structure as shown in FIGS. 8 and 9. The removable plate 12 is attached to the casing 13 of the atomizing chamber 4 so that each of the ultrasonic vibrators 2 ultrasonically vibrates the petroleum in the atomizing chamber 4.

The removable plate 12 shown in FIGS. 6 and 7 includes a surface plate 12A and a back plate 12B, and the surface plate 12A and the back plate 12B are laminated and the ultrasonic vibrator 2 is interposed between the surface plate 12A and the back plate 12B in the waterproof structure. The surface plate 12A has a through hole 12*a* opened and a vibrating surface 2A is positioned in the through hole 12*a* so that the ultrasonic vibrator 2 is interposed and fixed between the surface plate 12A and the back plate 12B. The back plate 12B is provided with a concave portion 12*b* for fitting the ultrasonic vibrator 2, and the ultrasonic vibrator 2 is fitted in the concave portion 12*b*. While the removable plate 12 shown in FIG. 6 has the concave portion 12*b* provided on the back plate 122B, a concave portion can also be provided on the surface plate to fit the ultrasonic vibrator.

In order to employ the waterproof structure between the ultrasonic vibrator 2 and the back plate 12A, a packing 16 is interposed between the surface plate 12A and the ultrasonic vibrator 2. In the atomizing machine 1 shown in FIG. 6, the packing 16 is also interposed between the ultrasonic vibrator 2 and the back plate 12B to employ the waterproof structure. The atomizing machine does not need to employ the waterproof structure between the ultrasonic vibrator and the back plate. The reason is as follows. The removable plate to employ the waterproof structure between the ultrasonic vibrator and the back plate is fixed to the lower surface of the casing in the atomizing chamber so that the petroleum in the atomizing chamber can be prevented from leaking. The packing 16 is an O ring of a rubber elastic member. The packing 16 of the O ring is provided on the opposed surfaces of the outer peripheral edge of the vibrating surface 2A of the ultrasonic vibrator 2 and the surface plate 12A, and the waterproof structure is employed between the vibrating surface 2A of the ultrasonic vibrator 2 and the surface plate 12A to prevent water from leaking out. Furthermore, the outer periphery of the ultrasonic vibrator 2 and the back plate 12B are coupled to each other in the waterproof structure.

The packing 16 is a rubber elastic member such as Teflon (registered trademark), silicon, natural or synthetic rubber, or the like. The packing 16 is interposed in an elastic deformation and crush state between the ultrasonic vibrator 2 and the surface plate 12A and between the ultrasonic vibrator 2 and the back plate 12B and adheres to the ultrasonic vibratos 2 and the surfaces of the surface plate 12A and the back plate 12B without a clearance so that the coupling portion takes the waterproof structure. For the packing 16, it is also possible to use a metal packing obtained by processing, like a ring, a metal such as copper, brass, aluminum or stainless.

The removable plate 12 shown in FIGS. 6 and 7 couples the either side edges of the surface plate 12A and the back plate 121B through a hinge 17. The removable plate 12 can easily remove and attach the ultrasonic vibrator 2 by opening the back plate 12B and the surface plate 12A. When the ultrasonic vibrator 2 is to be exchanged, the back plate 12B and the surface plate 12A are opened. In this condition, an old ultrasonic vibrator is taken out and a new ultrasonic vibrator 2 and a new packing 16 are put in predetermined positions. Then, the back plate 12B and the surface plate 12A are closed so that the ultrasonic vibrator 2 is exchanged. The back plate 12B and the surface plate 12A which are closed are coupled at the opposite side of the hinge 17 with a setscrew (not shown) or are fixed and coupled to the casing 13 of the atomizing chamber 4.

Figure 10:
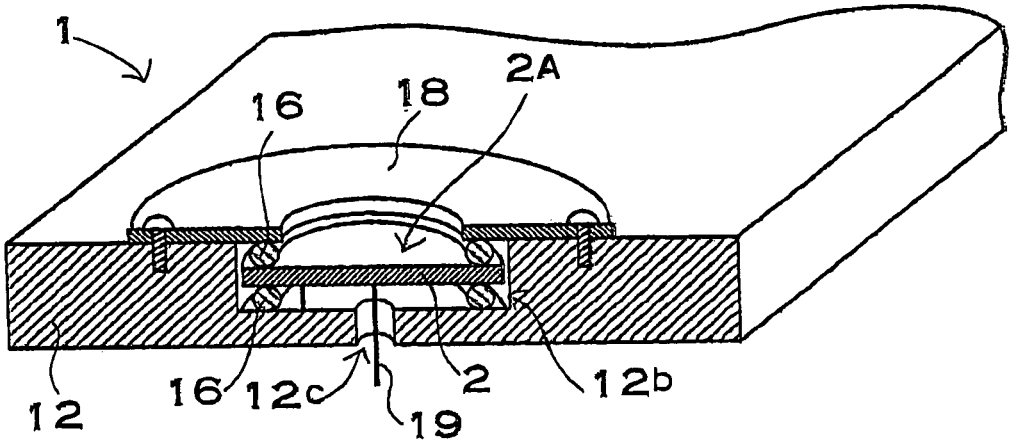
FIG. 10 is an enlarged sectional perspective view showing another example of the coupling structure of the ultrasonic vibrator and the removable plate.
Figure 11:
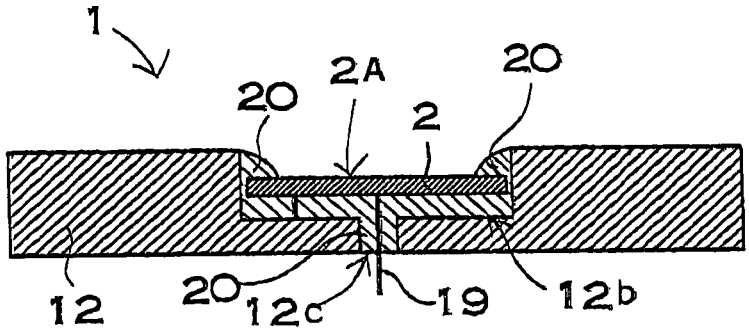
FIG. 11 is an enlarged sectional view showing a further example of the coupling structure of the ultrasonic vibrator and the removable plate.
Figure 12:
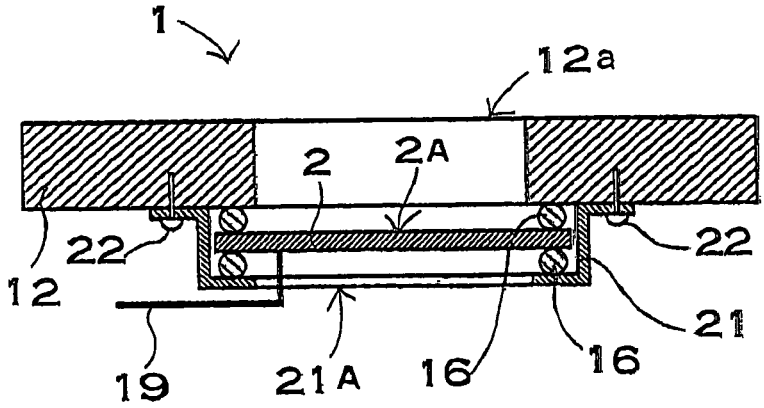
FIG. 12 is an enlarged sectional view showing a further example of the coupling structure of the ultrasonic vibrator and the removable plate.

While the atomizing machine 1 described above employs the waterproof structure by using the packing 16, it is also possible to employ the waterproof structure by filling a coking material in the position of the packing 16. While the removable plate 12 is constituted by two meal plates or non-metal hard plates including the surface plate 12A and the back plate 12B in the atomizing machine 1 shown in FIG. 6, furthermore, the removable plate 12 can also be formed by one plate as shown in FIGS. 10 to 12. The removable plate 12 is a metal plate or a non-metal hard plate and has the concave portion 12*b* for providing the ultrasonic vibratos 2 in an upper part or the through hole 12*a* opened.

In the atomizing machine 1 shown in FIG. 10, the ultrasonic vibratos 2 is put in the concave portion 12*b* of the removable plate 12 and the packing 16 is provided in the upper and lower parts of the outer peripheral portion of the ultrasonic vibrator 2. Furthermore, a ring plate 18 is fixed to the opening portion of the removable plate 12. The ring plate 18 presses the packing 16 provided on the upper surface of the ultrasonic vibrator 2, and fixes the ultrasonic vibrator 2 to the concave portion 12*b* in the waterproof structure. The concave portion 12*b* has the through hole 12*c* provided on a bottom and a lead wire 19 is led out.

In the atomizing machine 1 shown in FIG. 11, neither the packing nor the ring plate is used and the ultrasonic vibrator 2 put in the concave portion 12*b* of the removable plate 12 is bonded and fixed through a coking material 20 in the waterproof structure. The ultrasonic vibrator 2 also leads the lead wire 19 out of the through hole 12*c* opened on the bottom of the concave portion 12*b*. The coking material 20 is also filled between the through hole 12*c* and the lead wire 19 so that the waterproof structure in which water can be prevented from leaking is obtained.

In the atomizing machine 1 shown in FIG. 12, the through hole 12*a* is opened on the removable plate 12, and the vibrating surface 2A is positioned on the through hole 12*a* and the ultrasonic vibrator 2 is thus fixed to the lower surface of the removable plate 12. In order to fix the ultrasonic vibrator 2 to the removable plate 12, a fixture 21 is secured to the bottom face of the removable plate 12. The ultrasonic vibrator 2 is fixed to the removable plate 12 in the waterproof structure through the packing 16 provided in the upper and lower parts of the outer peripheral portion. The fixture 21 takes the shape of a ring having a step concave portion, and a fixing screw 22 penetrating through an outer peripheral edge portion is screwed and fixed into the removable plate 12. The fixture 21 presses the packing 16 provided on the lower surface of the ultrasonic vibrator 2 at the bottom face of the step concave portion and fixes the ultrasonic vibrator 2 to the removable plate 12 in the waterproof structure. The fixture 21 is provided with a through hole 21A on the bottom face of the step concave portion from which the lead wire 19 is led out.

FIGS. 8 and 9 show the atomizing chamber 4 for fixing the atomizing machine 1. The atomizing chamber 4 shown in these drawings has an opening portion 13A provided on the bottom face of the casing 13, and the removable plate 12 is fixed to close the opening portion 13A in the waterproof structure. The removable plate 12 is fixed to the casing 13 through a packing 23 in the waterproof structure. In order to fix the removable plate 12, a fixture 24 is secured to the bottom face of the casing 13. The fixture 24 is L-shaped, and presses the removable plate 12 through a setscrew 25 penetrating through the fixture 24 and fixes the removable plate 12 to the casing 13 of the atomizing chamber 4. With this structure, the ultrasonic vibrators 2 fixed to the atomizing chamber 4 ultrasonically vibrates the petroleum from the bottom face of the casing 13 toward an upper surface. The removable plate 12 is attached removably to the bottom face of the casing 13 of the atomizing chamber 4 in order to close the opening portion 13A.

Figure 13:
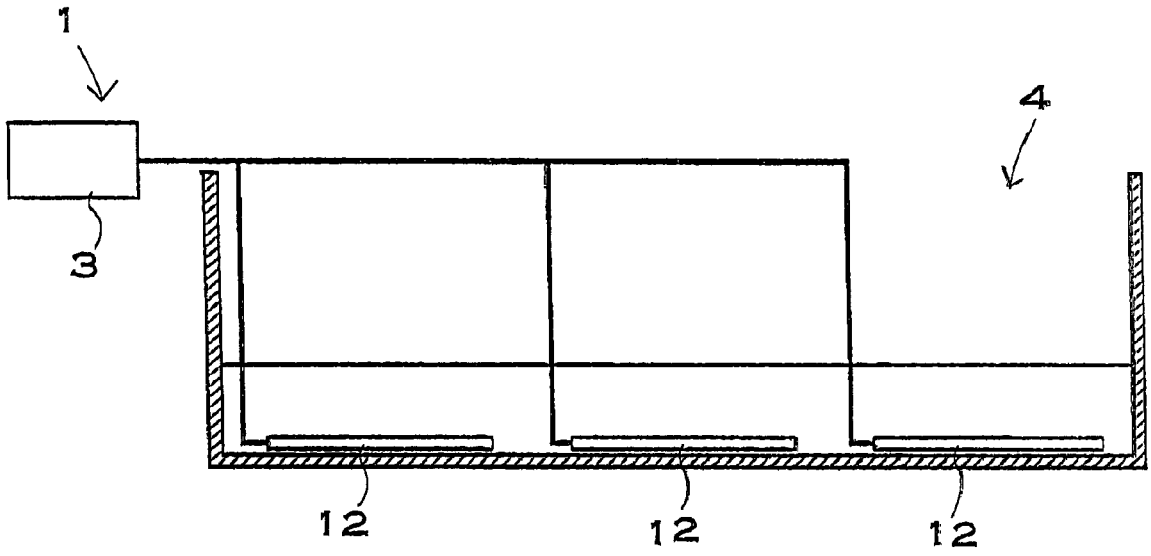
FIG. 13 is a sectional view showing another example of the arrangement of the removable plate in the atomizing chamber.

The removable plate 12 can also be immersed in the petroleum in the atomizing chamber 4 to ultrasonically vibrate the petroleum as shown in FIG. 13. With this structure, the removable plate 12 can easily be provided removably in the atomizing chamber 4. With the structure show in FIG. 11, for example, the atomizing machine 1 immersed in the petroleum fixes a portion excluding the vibrating surface 2A of the ultrasonic vibrator 2 to the removable plate 12 in the waterproof structure.

In some cases in which the petroleum in the atomizing chamber 4 is excessively heated to a high temperature by means of the ultrasonic vibrator 2 and the ultrasonic power supply 3, quality is deteriorated. It is possible to eliminate this drawback by forcibly cooling the ultrasonic vibrator 2. Furthermore, it is preferable that the ultrasonic power supply 3 should also be cooled. Although the ultrasonic power supply 3 does not directly heat the petroleum, surroundings are heated so that the petroleum is indirectly heated. The ultrasonic vibrator 2 and the ultrasonic power supply 3 can be provided in a state in which a cooling pipe is thermally coupled to them, that is, the cooling pipe is caused to come in contact with the ultrasonic vibrator 2 and the ultrasonic power supply 3, and can be thus cooled. The cooling pipe causes a liquid cooled by a cooling machine or a refrigerant, or cooling water such as underground water or service water to flow to cool the ultrasonic vibrator 2 and the ultrasonic power supply 3.

Figure 4:
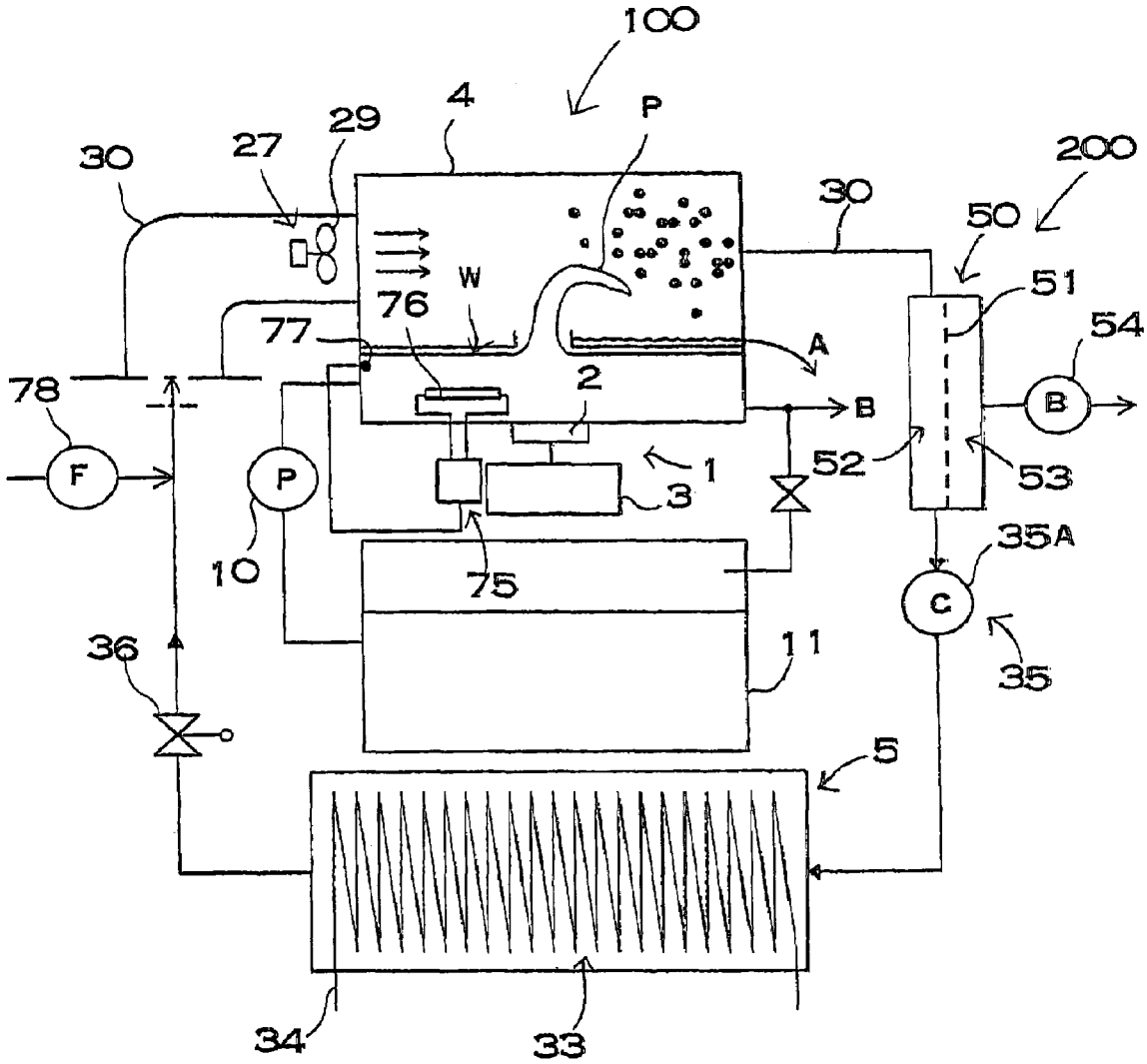
FIG. 4 is a schematic view showing a structure of an apparatus for separating petroleum according to a further example of the present invention.

Furthermore, the separating apparatus shown in FIG. 4 comprises a temperature control mechanism 75 for controlling the temperature of the petroleum in the atomizing chamber 4. The temperature control mechanism 75 raises the temperature of the petroleum in such a manner that the temperature of the petroleum reaches a predetermined temperature. The temperature control mechanism 75 detects the temperature of the petroleum stored in the atomizing chamber 4 by means of a temperature sensor 77, and furthermore, controls a heater 76 to maintain the temperature of the petroleum to be a set temperature of 40° C. Thus, the separating apparatus for controlling the temperature of the petroleum by the temperature control mechanism 75 can efficiently atomize the petroleum into the atomized fine particle.

The temperature of the petroleum influences the efficiency of atomizing the petroleum into the atomized fine particle by the ultrasonic vibration. When the temperature of the petroleum is dropped, the efficiently of the atomization into the atomized fine particle is deteriorated. When the temperature of the petroleum is low, the efficiency of the atomization into the atomized fine particle is reduced. Consequently, in consideration of the efficiency of the separation, the temperature of the petroleum is set to be a temperature at which the atomization into the atomized fine particle can be carried out efficiently. It is possible to efficiently atomize the petroleum having a high viscosity such as the crude oil into the atomized fine particle by raising the temperature to reduce the viscosity.

Figure 2:
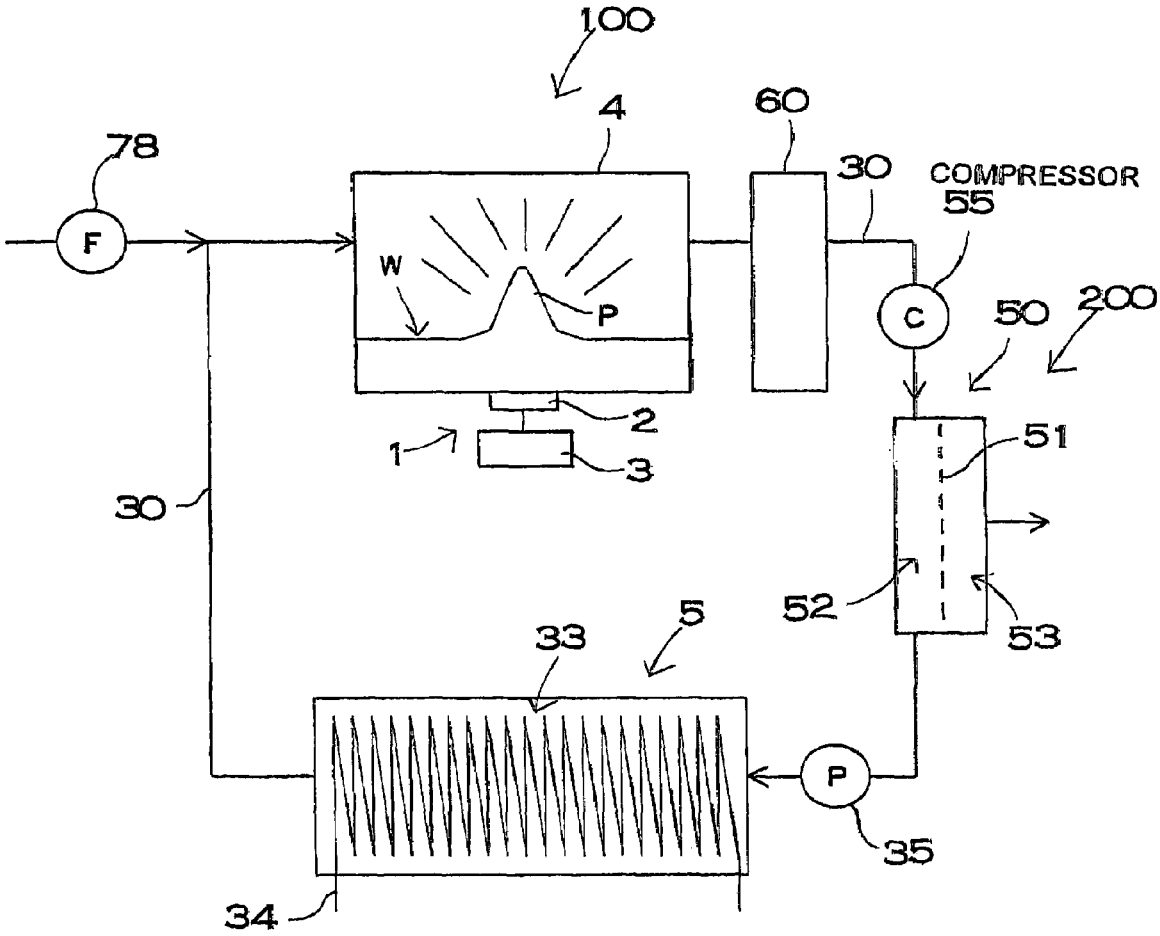
FIG. 2 is a schematic view showing a structure of an apparatus for separating petroleum according to another example of the present invention.
Figure 3:
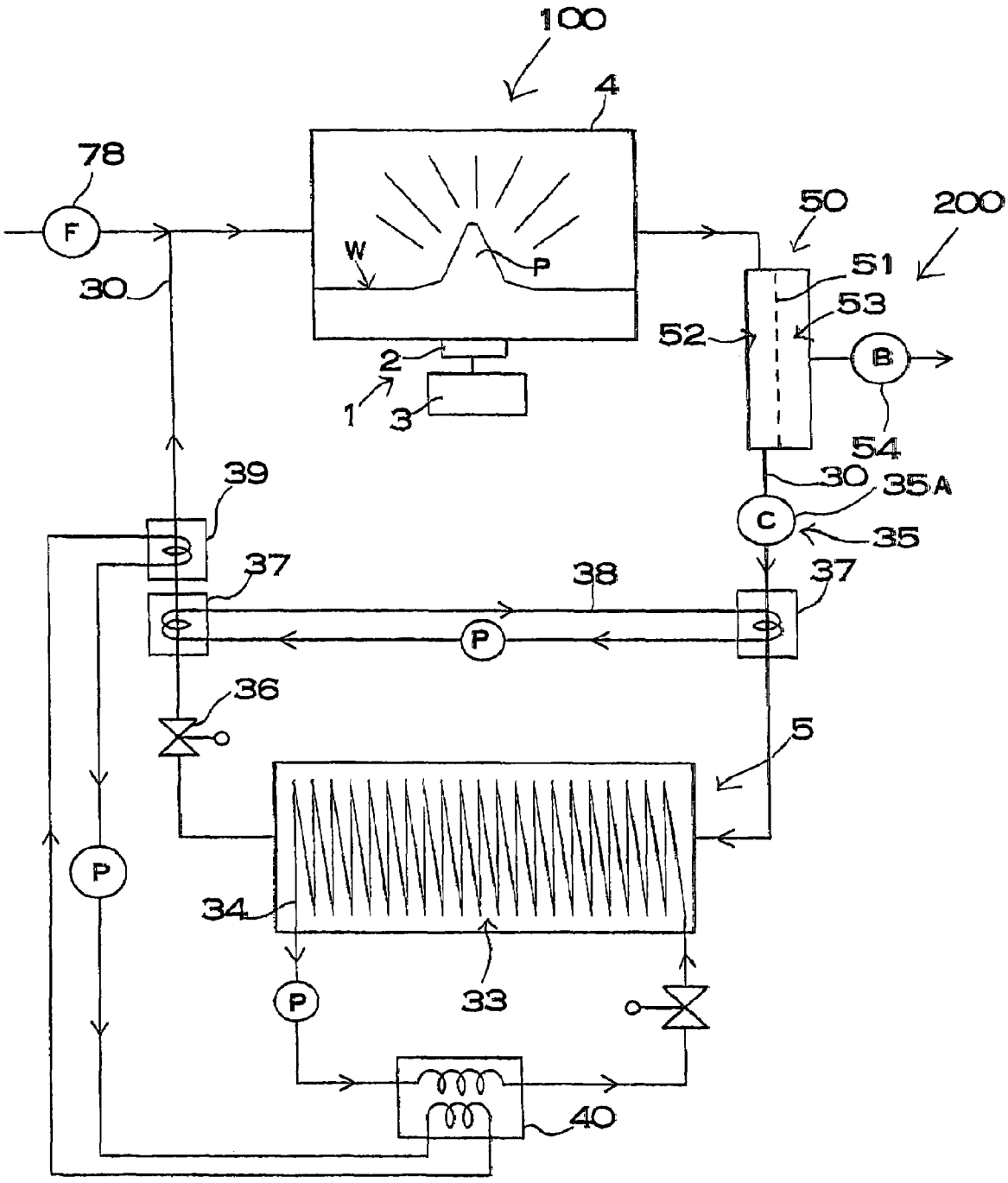
FIG. 3 is a schematic view showing a structure of an apparatus for separating petroleum according to a further example of the present invention.

In the separating apparatus shown in FIG. 4, furthermore, an ultrasonic vibration is carried out in the atomizing chamber 4 to cause air to blow from a blower mechanism 27 onto the liquid column P formed on the petroleum surface W. The blower mechanism 27 shown in FIG. 4 includes a fan 29 for causing the air to blow to the liquid column 27. Thus, the separating apparatus in which the air is blown against the liquid column P by means of the blower mechanism 27 has a feature that the atomization into the atomized fine particle can be efficiently carried out from the surface of the liquid column P. The separating apparatus according to the present invention does not need to comprise the blower mechanism to cause the air to blow against the squid column as shown in FIGS. 1 to 3.

The air separating machine 50 serves to separate air from a mixed fluid supplied from the atomizing chamber 4. The air separating machine 50 partitions the inner part of an air transmitting film 51 into a primary side passage 52 and a secondary side discharge path 53. The primary side passage 52 is coupled to the atomizing machine 1 to cause the mixed fluid to pass through the primary side passage 52. The secondary side discharge path 53 discharges the air separated from the mixed fluid by a transmission through the air transmitting film 51.

The air transmitting film 51 causes only the air to pass through the air transmitting film 51 and does not cause the atomized petroleum to pass through. In the air transmitting film 51, accordingly, there is used a molecular sieve to be a film having a pore size which does not cause the petroleum to pass through the air transmitting film 51 but causes the air to pass through the air transmitting film 51. The air contains approximately 80% of nitrogen and approximately 20% of oxygen. Accordingly, the air transmitting film 51 has such a pore size as to cause the nitrogen and the oxygen to pass through the air transmitting film 51. The pore size of the air transmitting film 51 is preferably 0.4 nm to 0.5 nm. The air transmitting film 51 does not cause a hydrocarbon mixture having a larger size than the pore size to pass through the air transmitting film 51 but causes the air containing the nitrogen and the oxygen having a smaller size than the pore size to pass through the air transmitting film 51. The air transmitting film 51 having the pore size is fabricated by coating the surface of ceramic with zeolite, for example.

In the air separating machine 50, the primary side passage 52 is coupled to the atomizing chamber 4 to cause the mixed fluid to come in contact with the primary side surface of the air transmitting film 51. Furthermore, the secondary side discharge path 53 is coupled to a forcible exhaust machine 54 in the apparatuses shown in FIGS. 1, 3 and 41, and a compressor 55 is coupled to the primary side passage 52 and the pressure of the primary side surface is set to be higher than that of the secondary side surface on an opposite side to cause the air of the mixed fluid to pass through the air transmitting film 51, so that the apparatus of FIG. 2 separates a part or whole of the air of the mixed fluid in the apparatus.

The forcible exhaust machine 54 is a suction pump such as a vacuum pump for forcibly sucking and discharging the air. The forcible exhaust machine 54 couples a suction side to the secondary side discharge path 53, and discharges the air in the secondary side discharge path 53 forcibly. In the secondary side discharge path 53 through which the air is discharged, a pressure is lower than an atmospheric pressure and is thus lower than the pressure in the primary side passage 52. More specifically, the pressure in the primary side passage 52 is relatively higher than that in the secondary side discharge path 53. In this condition, the air contained in the mixed fluid is transmitted through the air transmitting film 51, and then passes from the primary side passage 52 to the secondary side discharge path 53 and is thus separated from the mixed fluid.

The apparatus shown in FIG. 2 presses the mixed fluid into the primary side passage 52 through the pressing machine 55. The pressing machine 55 has a suction side coupled to the atomizing chamber 4. The secondary side discharge path 53 is opened to the air. It is also possible to couple the forcible discharge machine to the secondary side discharge path, and to reduce the pressure in the secondary side discharge path to be equal to or lower than the atmospheric pressure. The compressor 55 pressurizes the mixed fluid to have an atmospheric pressure or more and presses the mixed fluid into the primary side passage 52, and the pressure of the primary side passage 52 is set to be higher than that of the secondary side discharge path 53. In this condition, the air contained in the mixed fluid is transmitted through the air transmitting film 51 depending on a difference in a pressure between the primary side surface and the secondary side surface. The air transmitted through the air transmitting film 51 is moved from the primary side passage 62 to the secondary side discharge path 53 and is separated from the mixed fluid. With this structure, the difference in a pressure between the primary side surface and the secondary side surface in the air transmitting film 61 can be increased. Consequently, it is possible to quickly separate the air of the mixed fluid. The reason is that the compressor 55 can press the mixed fluid into the primary side passage 52 at a high pressure.

In the apparatus shown in FIG. 2, furthermore, the suction side of the compressor 55 is coupled to the atomizing chamber 4 through a collecting chamber 60 in a former stage. The separating apparatus can couple, as the collecting chamber 60 in the former stage, any of a cyclone, a punching plate, a demister, a chevron, a scrubber, a spray tower and an electrostatic collecting machine, and collect the atomized fine particle. The separating apparatus shown in FIG. 2 disposes these mechanisms between the air separating machine 50 and the atomizing chamber 4, so that the separating apparatus forming the collecting chamber 60 in the former stage. This apparatus supplies, to the air separating machine 50, a mixed fluid obtained by collecting a part of the atomized fine particles through the collecting machine 60 in the former stage. The separating machine can also couple any of the cyclone, the punching plate, the demister, the chevron, the scrubber, the spray tower and the electrostatic collecting machine between the air separating machine and the collecting chamber, and collect the atomized fine particle, which is not shown.

The air separated by the air separating machine 50 does not contain the petroleum. The apparatus shown in FIG. 1 supplies the air separated by the air separating machine 50 to the atomizing chamber 4. The apparatus for supplying the air separated by the air separating machine 50 to the atomizing chamber 4 can efficiently atomize the atomized fine particle in the atomizing chamber 4. The reason is that the air separated from the mixed fluid by the air separating machine 50 does not contain the petroleum. Moreover, the air separated by the air separating machine 50 is controlled to have an optimum temperature in the generation of the atomized fine particle in the atomizing chamber 4. Consequently, the air can be supplied to the atomizing chamber 4, so that the air generates the atomized fine particle efficiently.

The mixed fluid from which the air is separated by the air separating machine 50 has a small air content. In other words, the amount of the atomized fine particle for the air is increased so that the hydrocarbon mixture of the atomized fine particle is brought into an oversaturation state. As a result, it is possible to efficiently collect the atomized fine particle in the collecting chamber 5. Since the air is separated by the air separating machine 50, the amount of the air in the mixed fluid supplied to the collecting chamber 5 is lessened more greatly than the mixed fluid discharged from the atomizing chamber 4.

The mixed fluid from which a part of the air is separated by the air separating machine 50 is moved to the collecting chamber 5. The mixed fluid is supplied to the collecting chamber 5 by the forcible delivering machine 35 formed by a blower or a compressor. The forcible delivering machine 35 is coupled between the air separating machine 50 and the collecting chamber 5 in order to supply the mixed fluid from the air separating machine 50 to the collecting chamber 5. The forcible delivering machine 35 absorbs the mixed fluid from which a part of the air is separated by the air separating machine 50, and supplies the mixed fluid to the collecting chamber 5.

The apparatuses shown in FIGS. 3 and 4 use a compressor 35A in the forcible delivering machine 35. By using the compressor 35A in the forcible delivering machine 35, it is possible to pressurize the mixed fluid to have an atmospheric pressure or more, and to supply the mixed fluid to the collecting chamber 5. In the separating apparatus, the partial pressure of the saturated vapor of the petroleum in a vapor phase can be set to be lower than the partial pressure of the saturated vapor under an atmospheric pressure and the atomized fine particle can be coagulated and collected more effectively in the collecting chamber 5.

For the compressor 35A, it is possible to use a compressor of a Lysholm compressor as a compressor of a piston type, a compressor of a rotary type or a compressor of a diaphragm type. It is preferable that a type capable of feeding the mixed fluid at a pressure of 0.2 to 1 MPa should be used for the compressor 35A.

In an apparatus for raising the pressure of the collecting chamber 5 by using the compressor 35A for the forcible delivering machine 35, a throttle valve 36 is coupled to the discharge side of the collecting chamber 5. In the case in which the flow rate of the mixed fluid supplied to the collecting chamber by the compressor is high, it is not always necessary to provide the throttle valve on the discharge side of the collecting chamber. The reason is that the compressor can supply a large amount of the mixed fluid to the collecting chamber, and set the pressure of the collecting chamber to be equal to or higher than the atmospheric pressure in the case in which a passing resistance on the discharge side of the collecting chamber is high. The throttle valve can be coupled to the discharge side of the collecting chamber, and pressurize the collecting chamber to have the atmospheric pressure or more efficiently. The throttle valve 36 increases the passing resistance of the mixed fluid discharged from the collecting chamber 35A, and raises the pressure of the collecting chamber 5. It is possible to use, for the throttle valve 36, a valve capable of regulating an opening to adjust the passing resistance of the mixed fluid, a piping obtained by raising the passing resistance of the mixed fluid with a thin tube such as a capillary tube or a valve obtained by filling a piping with a resistance material for raising the passing resistance of the mixed fluid. When the throttle valve 36 increases the passing resistance, the pressure of the collecting chamber 5 is raised.

Figure 14:
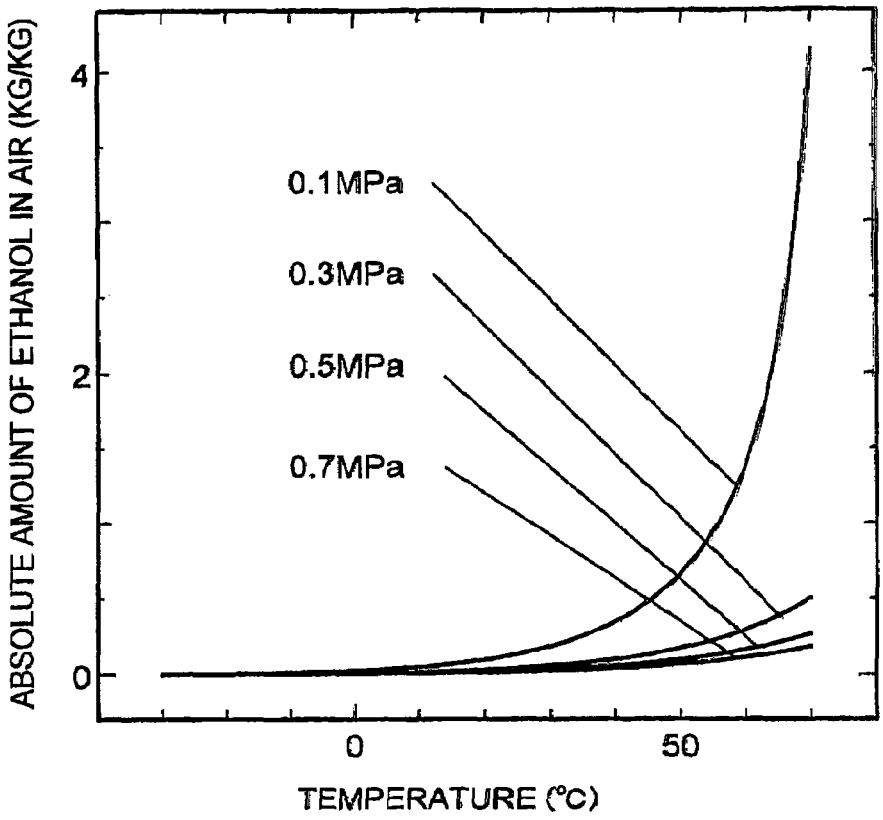
FIG. 14 is a graph showing the absolute amount of ethanol in the air under pressure.

FIG. 14 shows a state in which the amount of the hydrocarbon mixture contained in the air to be the mixed fluid is decreased when the collecting chamber 5 is pressurized to have an atmospheric pressure or more. As is apparent from the graph, in the air of the mixed fluid, the amount of the hydrocarbon mixture which can be contained in the state of a gas is increased when a temperature is raised. However, the amount of the hydrocarbon mixture which can be contained in the state of the gas is suddenly decreased when a pressure is raised. For example, in the case in which the hydrocarbon mixture is ethanol, the amount of the ethanol which can be contained in dry air at 30° C. is remarkably decreased to be approximately ⅕ when the pressure is raised to be 0.1 MPa to 0.5 MPa of an atmospheric pressure. When the maximum amount of the ethanol which can be contained in the state of the gas is decreased, a larger amount of the ethanol than the maximum amount of the ethanol is wholly brought into the state of an oversaturated atomized fine particle and can be thus collected efficiently. The ethanol contained in the state of the gas is coagulated and cannot be collected if it is not charged into the atomized fine particle. If an ultrasonic vibration atomizes the petroleum into the state of the atomized fine particle and the atomized fine particle is vaporized into the state of the gas, moreover, the atomized fine particle is coagulated and cannot be collected. Even if the atomized fine particle is vaporized, furthermore, it can be liquefied and collected again in the oversaturation state. The mixed fluid containing the atomized fine particle is pressurized to have the atmospheric pressure or more to drop the partial pressure of the saturated vapor of the petroleum, and consequently, the petroleum contained in the mixed fluid can be efficiently collected in the state of the atomized fine particle in place of the state of the gas. By coding the mixed fluid, it is also possible to drop the partial pressure of the saturated vapor. However, a pressurizing method has a feature that the partial pressure of the saturated vapor can be efficiently dropped very easily by using a compressor with a small energy. By cooling and pressurizing the mixed fluid at the same time, furthermore, it is also possible to further drop the partial pressure of the saturated vapor of the petroleum, and collect the petroleum more efficiently.

When the compressor 35A compresses the mixed fluid, the mixed fluid is adiabatically compressed to generate heat. When the mixed fluid passes through the throttle valve 36, moreover, it is adiabatically expanded and cooled. It is preferable that the mixed fluid supplied from the compressor 35A to the collecting chamber 5 should be cooled in order to efficiency collect the atomized fine particle. When the heat is generated, a collection efficiency is deteriorated. In order to lessen the drawback, the apparatus in FIG. 3 is provided with a heat exchanger 37 for exhaust heat for exchanging heat on the discharge side of the throttle valve 36 and the discharge side of the compressor 35A, that is, the inflow side of the collecting chamber 5. The heat exchanger 37 for exhaust heat cools the mixed fluid compressed adiabatically and heated by the compressor 35A with the mixed fluid expanded adiabatically and cooled on the discharge side of the throttle valve 36.

The heat exchanger 37 for exhaust heat circulates a refrigerant in a circulating pipe 38. The circulating pipe 38 has one of ends coupled thermally to the discharge side of the throttle valve 36 and the other end coupled thermally to the discharge side of the compressor 35A. The refrigerant circulated in the circulating pipe 38 is cooled at the discharge side of the throttle valve 36. The refrigerant cooled cools the discharge side of the compressor 35A. In the circulating pipe 38, a portion to be coupled thermally is set to have a double tube structure and the mixed fluid and the refrigerant are coupled thermally to each other, which is not shown.

Furthermore, the apparatus shown in FIG. 3 comprises a second heat exchanger 39 for exhaust heat for coupling the discharge side of the throttle valve 36 to a condenser 40 for cooling the heat exchanger 33 for cooling. The second heat exchanger 39 for exhaust heat has the same structure as that of the heat exchanger 37 for exhaust heat described above, and serves to cool the refrigerant on the discharge side of the throttle valve 36, to cool the condenser 40 with the cooled refrigerant, and to liquefy the refrigerant circulated in the condenser 40.

In the apparatuses shown in FIGS. 2 to 4, the atomizing chamber 4, the air separating machine 50 and the collecting chamber 5 are coupled through a circulating duct 30, and circulate the mixed fluid to the atomizing chamber 4 and the collecting chamber 5. Furthermore, the outside air is inhaled through an intake fan 78 and is thus supplied to the atomizing chamber 4. An apparatus in which the intake fan 78 supplies the outside air to the atomizing chamber 4 can efficiently atomize the petroleum of the atomizing chamber 4 by utilizing the thermal energy of the outside air. The thermal energy of the outside air inhaled through the intake fan 78 efficiently atomizes the petroleum in the atomizing chamber 4 into the atomized fine particle, and furthermore, vaporizes the atomized fine particle efficiently. The reason is that the petroleum in the atomizing chamber 4 can raise the temperature of the air to be supplied, and enhance an atomization efficiently. The outside air taken in through the intake fan 78 has a thermal energy by itself. A device for vaporizing the atomized fine particle by effectively utilizing the thermal energy contained in the outside air efficiently atomizes the petroleum into the atomized fine particle by effectively utilizing the thermal energy of the outside air, and furthermore, vaporizes the atomized fine particle efficiently. Accordingly, this device can efficiently atomize the petroleum in the atomizing chamber 4 into the atomized fine particle, and furthermore, can efficiently vaporize the atomized fine particle without heating the air to be supplied to the atomizing chamber 4 by means of a heater, a burner or the like. The intake fan 78 supplies, to the atomizing chamber 4, the air corresponding to the amount of the air to be discharged through the air separating machine 50. In other words, the amount of the air to be taken from the intake fan 78 to the atomizing chamber 4 is separated from the mixed fluid and is discharged to an outside by means of the air separating machine 50.

Figure 15:
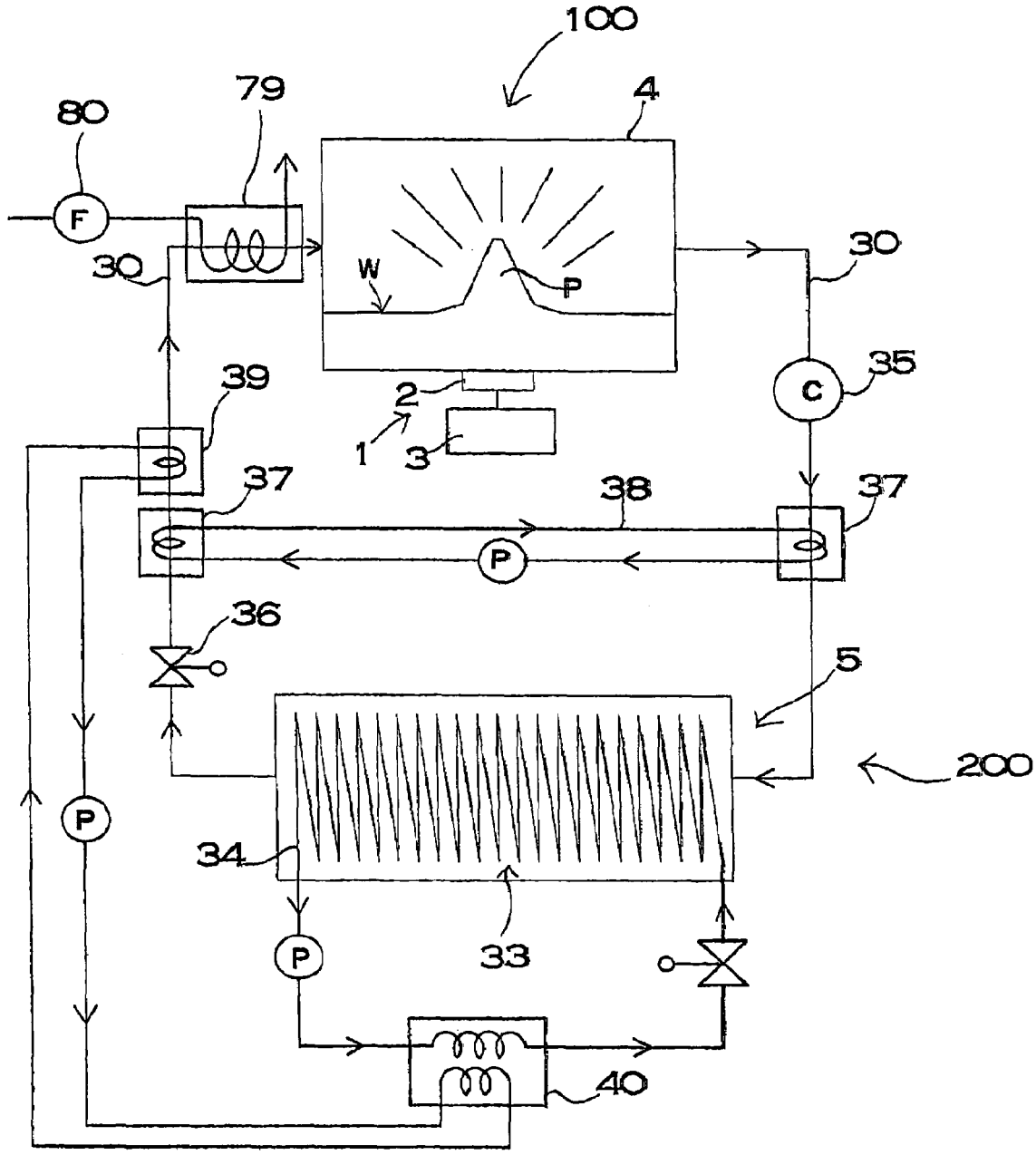
FIG. 15 is a schematic view showing a structure of an apparatus for separating petroleum according to a further example of the present invention.

An apparatus shown in FIG. 15 is not provided with the air separating machine but circulates the air separated from a hydrocarbon mixture contained in the mixed fluid to the atomizing chamber 4. The air circulated to the atomizing chamber 4 is heated by the outside air heat exchanger 79. The outside air heat exchanger 79 heats the air circulated to the atomizing chamber 4 with the thermal energy of the outside air. The outside air heat exchanger 79 fixes a large number of radiation fins (not shown) to a piping for causing the circulated air to pass through the outside air heat exchanger 79, and sends the outside air to the radiation fins through a forcible blower fan 80, and heats the circulated air with the outside air.

In the apparatus shown in FIG. 1, the discharge side of the atomizing chamber 4, the air separating machine 50 and the supply side of the collecting chamber 5 are coupled through the circulating duct 30, and the discharge side of the collecting chamber 5 and the supply side of the atomizing chamber 4 are not coupled through the circulating duct 30. This apparatus can circulate the air separated through the air separating machine 50 to the atomizing chamber 4, and atomize petroleum into the atomizing fine particle in the atomizing chamber 4 efficiently. The reason is that the air containing no petroleum is supplied to the atomizing chamber 4. Furthermore, this apparatus can heat the circulated air by the outside air heat exchanger 79, and atomize the petroleum more efficiently. Moreover, this apparatus can also circulate, to the atomizing chamber 4, both the air separated from the hydrocarbon mixture through the air separating machine 50 and the air separated from the hydrocarbon mixture in the collecting device 2 as shown in a chain line of FIG. 1.

The collecting chamber 5 shown in FIGS. 1 to 4 includes the heat exchanger 33 for cooling which serves to cool and condense the atomized fine particle. The heat exchanger 33 for cooling fixes a fin (not shown) to the heat exchange pipe 34. A refrigerant for cooling or cooling water is circulated to the heat exchange pipe 34, and cools the heat exchanger 33 for cooling. The atomized fine particle which is obtained in the atomizing chamber 4 is partially vaporized and changed into the gas. However, the gas is cooled by the heat exchanger 33 for cooling in the collecting chamber 5, and is condensed, flocculated and collected. The atomized fine particle flowing into the collecting chamber 5 collides with the heat exchanger 33 for cooling or collides with each other and is greatly condensed, or collides with the fin of the heat exchanger 33 for cooling or the like, is greatly condensed and is collected. The air obtained by condensing and collecting the atomized fine particle and the gas through the heat exchanger 33 for cooling is circulated into the atomizing chamber 4 again through the circulating duct 30.

Figure 16:
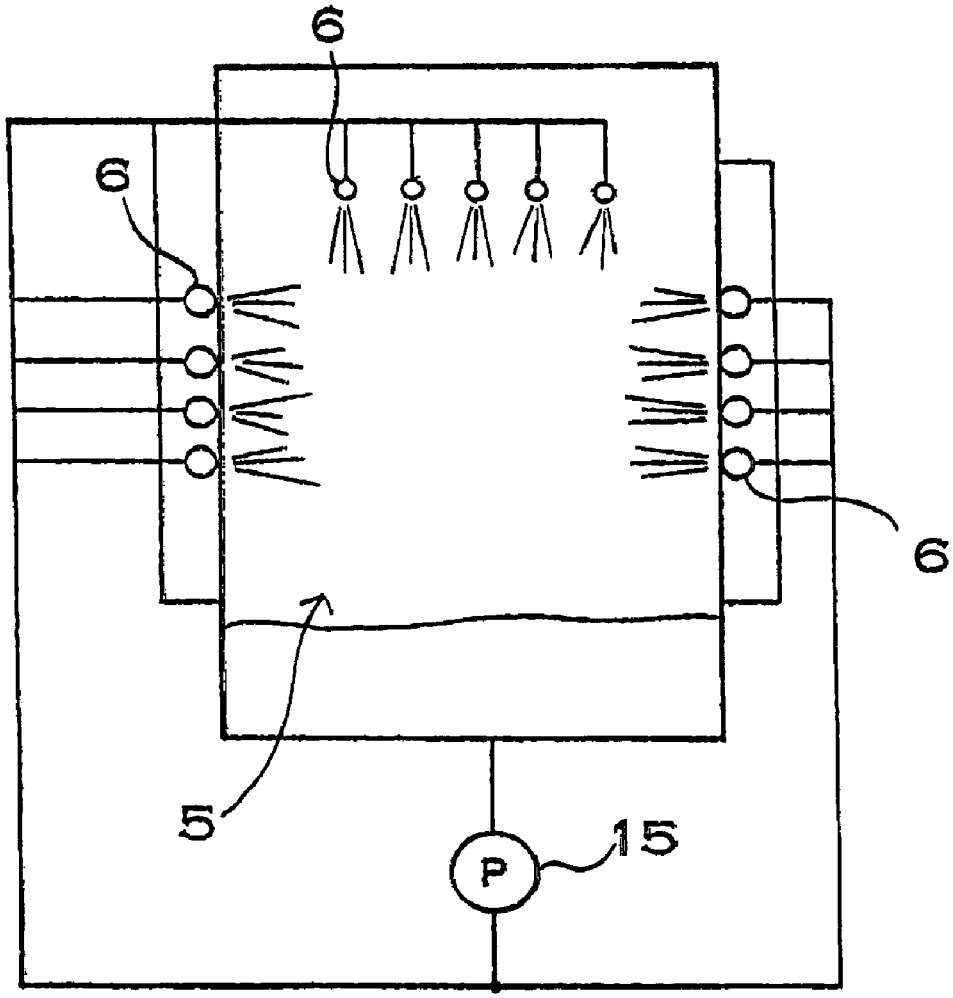
FIG. 16 is a schematic sectional view showing an example of a collecting chamber.

In order to collect the atomized fine particle in the collecting chamber 5 more quickly, the collecting chamber 5 in FIG. 16 includes a nozzle 6 for jetting the petroleum. The nozzle 6 is coupled to the bottom portion of the collecting chamber 5 through a circulating pump 15. The circulating pump 15 inhales the petroleum collected in the collecting chamber 5 and sprays the petroleum from the nozzle 6.

In the separating apparatus shown in the drawing, the nozzle 6 is provided in the upper part of the collecting chamber 5. The nozzle 6 in the upper part sprays the petroleum downward. The petroleum sprayed from the nozzle 6 is a sufficiently larger waterdrop as compared with the atomized fine particle which is atomized by the atomizing machine 1 and drops quickly in the collecting chamber 5 and collides with the atomized fine particle floating in the collecting chamber 5 during the dropping, and drops while collecting the atomized fine particle. Accordingly, it is possible to collect the atomized fine particle floating in the collecting chamber 5 efficiently and quickly.

While the separating apparatus shown in the drawing has the nozzle 6 provided in an upper part, it is also possible to dispose the nozzle in the lower part of the collecting chamber 5. The nozzle in the lower part sprays the petroleum upward. The nozzle sprays the petroleum at such a speed as to cause the petroleum to collide with the ceiling of the collecting chamber 5 or such a speed as to rise to the vicinity of the ceiling. The petroleum sprayed to rise to the vicinity of the ceiling changes a direction downward in the vicinity of the ceiling and thus drops. Consequently, the petroleum efficiently collects the atomized fine particle in contact with the atomized fine particle when it rises and drops.

Figure 17:
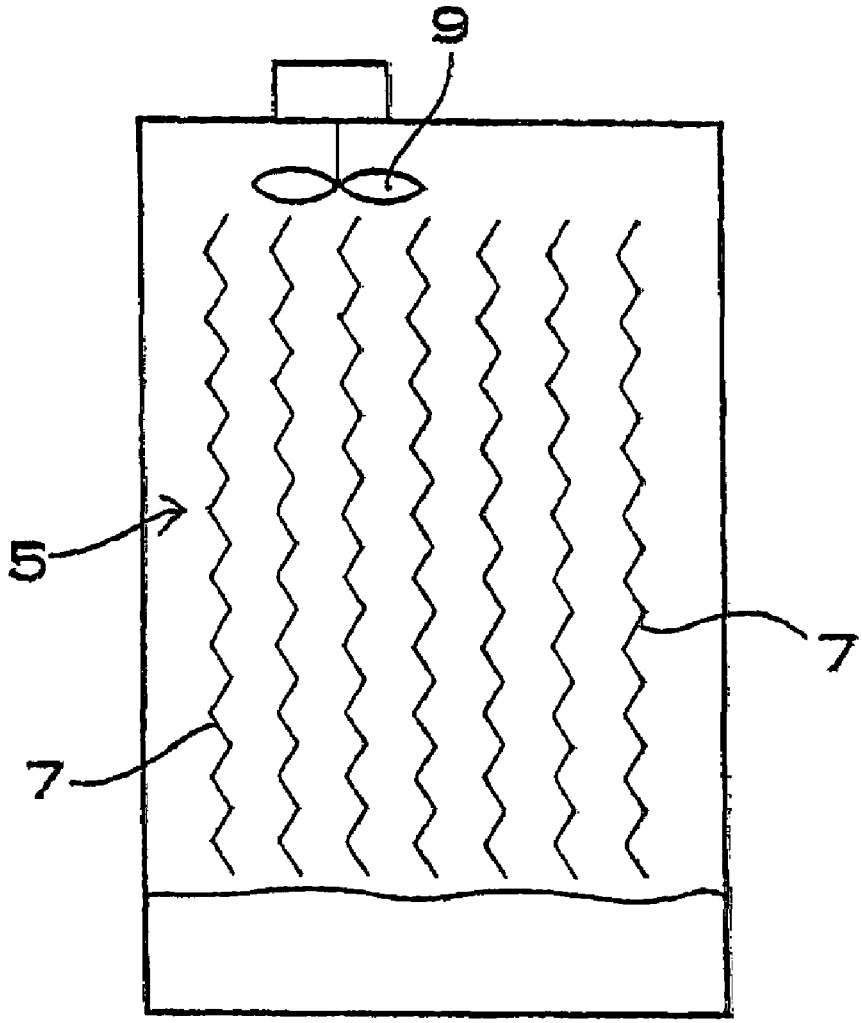
FIG. 17 is a schematic sectional view showing another example of the collecting chamber.

The collecting chamber 5 in FIG. 17 has a plurality of baffle plates 7 provided inside. The baffle plate 7 forms a clearance capable of causing the atomized fine particle to pass through the baffle plate 7 together with the adjacent baffle plate 7 and is disposed in a vertical posture. The vertical baffle plate 7 can cause the atomized fine particle to collide with a surface and to cause the sticking petroleum to naturally flow down so as to be collected. The baffle plate 7 in FIG. 17 has a concavo-convex surface and can cause the atomized fine particle to come in contact with the baffle plate 7 so as to be collected more efficiently.

Furthermore, the collecting chamber 5 in FIG. 17 is provided with a fan 9 for forcibly sending and stirring the atomized fine particle. The fan 9 stirs the atomized fine particle in the collecting chamber 5. The atomized fine particles which are stirred collide with each other and are flocculated or collide with the surface of the baffle plate 7 and are flocculated. The flocculating atomized fine particle drops quickly and is thus collected. The fan 9 in FIG. 17 sends and circulates the atomized fine particle in the collecting chamber 5 downward.

Figure 18:
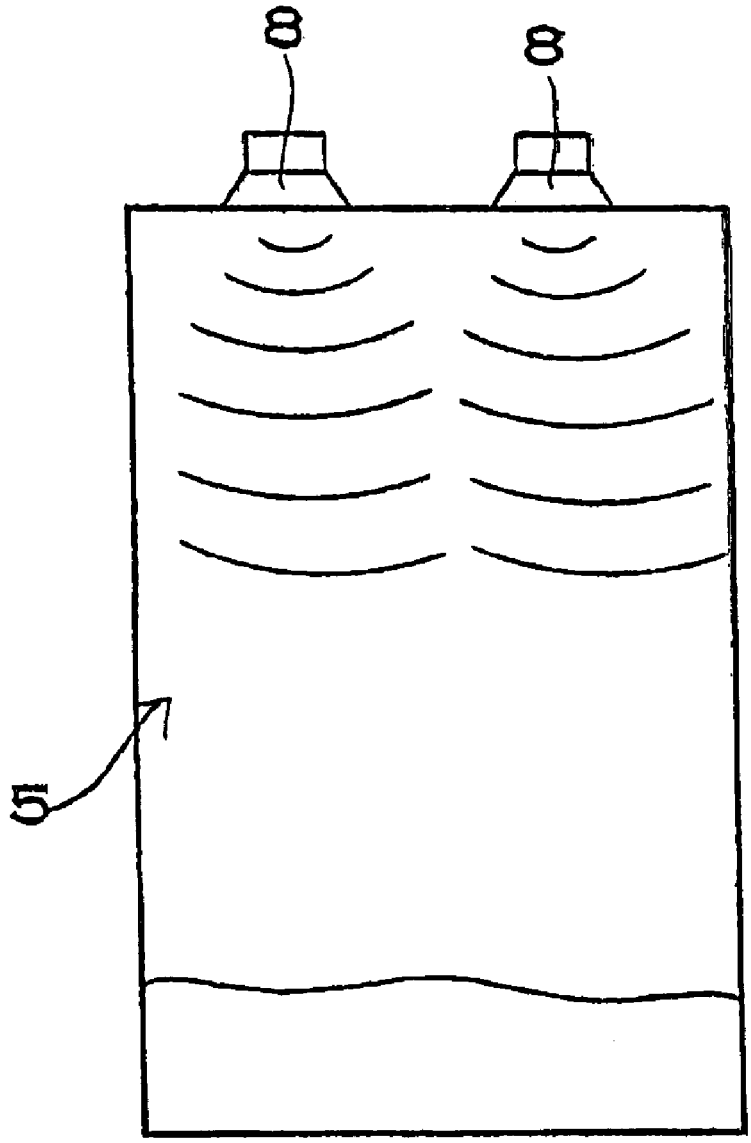
FIG. 18 is a schematic sectional view showing a further example of the collecting chamber.

The collecting chamber 5 in FIG. 18 is provided with an atomized fine particle vibrator 8 for increasing a probability that the atomized fine particles might be vibrated to collide with each other. The atomized particle vibrator 8 includes an electrical vibration-mechanical vibration converter for vibrating a gas in the collecting chamber 5, and a vibration power supply for driving the electrical vibration-mechanical vibration converter. The electrical vibration-mechanical vibration converter is a speaker for radiating a sound having an audible frequency, an ultrasonic vibrator for radiating a higher ultrasonic wave than the audible frequency, or the like. In order for the electrical vibration-mechanical vibration converter to vibrate the atomized fine particle efficiently, a vibration radiated from the electrical vibration-mechanical vibration converter is resonated in the collecting chamber 5. In order to implement the resonation, the electrical vibration-mechanical vibration converter carry out a vibration at a frequency which is resonated in the collecting chamber 5. In other words, the collecting chamber 5 is designed to take such a configuration as to be resonated with the vibration radiated from the electrical vibration-mechanical vibration converter.

The ultrasonic wave has a high frequency which exceeds a human audible frequency, and accordingly, people cannot hear the ultrasonic wave. For this reason, the atomized fine particle vibrator 8 for radiating the ultrasonic wave violently vibrates a gas in the collecting chamber 5, that is, increases the output of the electrical vibration-mechanical vibration converter very greatly so that the people are not influenced by the damage of a sound. For this reason, the ultrasonic wave has a feature that the atomized fine particles can be violently vibrated to efficiently collide with each other, and can be thus collected quickly.

In the separating apparatus described above, the device for efficiently flocculating the atomized fine particle is provided in the collecting chamber 5. Consequently, it is possible to flocculate the atomized fine particle more quickly. Furthermore, the separating apparatus according to the present invention can include all of the nozzle for spraying the petroleum, the fan for stirring the atomized fine particle, and the vibrator for vibrating the atomized fine particle in the collecting chamber, so that the separating apparatus can flocculate the atomized fine particle most efficiently, which is not shown. Moreover, the separating apparatus can include two devices for flocculating the atomized fine particle, so that the separating apparatus flocculate the atomized fine particle efficiently.

The petroleum can be atomized into the atomized fine particle by the ultrasonic vibration and can be thus separated into the hydrocarbon mixtures having different components. The reason is that the petroleum having a large content of hydrocarbons having a small number of carbons (n) is atomized into the atomized fine particle by the ultrasonic vibration more effectively and the petroleum having a large number of carbons (n) is atomized in a small amount by the ultrasonic vibration.

Figure 19:
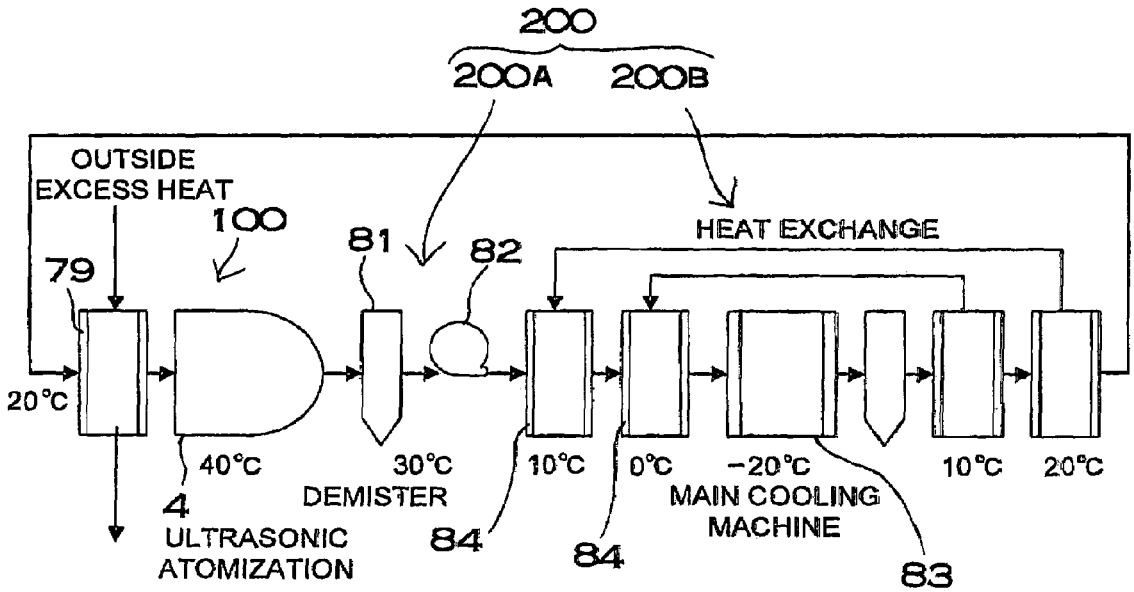
FIG. 19 is a schematic view showing a structure of an apparatus for separating petroleum according to a further example of the present invention.

FIG. 19 shows an apparatus for collecting a mixed fluid atomized into an atomized fine particle in a multistage. The apparatus atomizes the mixed fluid into the atomized fine particle by an ultrasonic vibration in a state in which the petroleum is heated to 40° C. The air supplied to the atomizing chamber 4 is heated by the outside air heat exchanger 79. The outside air heat exchanger 79 heats the air with a thermal energy contained in the outside air and supplies the heated air to the atomizing chamber 4. The atomized fine particle is mixed with the air through a carrier gas and is changed into the mixed fluid. Any of the hydrocarbon mixtures contained in the mixed fluid which is not vaporized but left and has a large particle size is collected in a demister 81 to be a first collecting device 200A. The demister 81 to be the first collecting device 200A may be at least one of a chevron, a punching plate, a mesh, a demister, a cyclone, an electrostatic field collecting device, a filter, a scrubber, an atomized fine particle collecting device using an ultrasonic vibration, a bundle of capillaries and a honeycomb or their combination.

The air to be the carrier gas obtained by partially separating the hydrocarbon mixture in the demister 81 to be the first collecting device 200A is supplied to a second collecting device 200B to be a next step through a bower 82. The blower 82 has a suction side coupled to the atomizing chamber 4 and a discharge side coupled to the second collecting device 200B in a next stage. In this apparatus, the pressure of the atomizing chamber 4 is reduced to be lower than an atmospheric pressure through the blower 82, and the pressure of the second collecting device 200B is raised to be higher than the atmospheric pressure. The atomizing chamber 4 having the pressure reduced promotes the vaporization and atomization of the petroleum. In the second collecting device 200B thus pressurized, the relative vapor pressure of the petroleum is reduced to promote a condensation. The collecting device 200 cools an atomized vapor phase which is vaporized or changed into an aerosol, and separates a hydrocarbon mixture from the air and collects the hydrocarbon mixture. In the collecting device 200 in this drawing, a heat exchanger 84 for collection is coupled to the inflow and discharge sides of a main cooling machine 83 in a multistage. By circulating a refrigerant in order of a short distance from the main cooling machine 83, it is possible to move the heat of the entering mixed fluid to a vapor phase at the outlet of the main coding machine 83 and to move a cold at the outlet of the main cooling machine 83 to a vapor phase at the inlet of the collecting portion to be the outlet of the atomizing portion. Thus, it is possible to constitute a process for separating the petroleum by a one-pass method. With this structure, it is possible to effectively utilize the heat of the air on the outside of the apparatus. The collecting device 200 can collect the petroleum in descending order of the content of the hydrocarbon mixture having a large number of carbons (n) from the atomizing chamber 4 to the main cooling machine 83.

Figure 20:
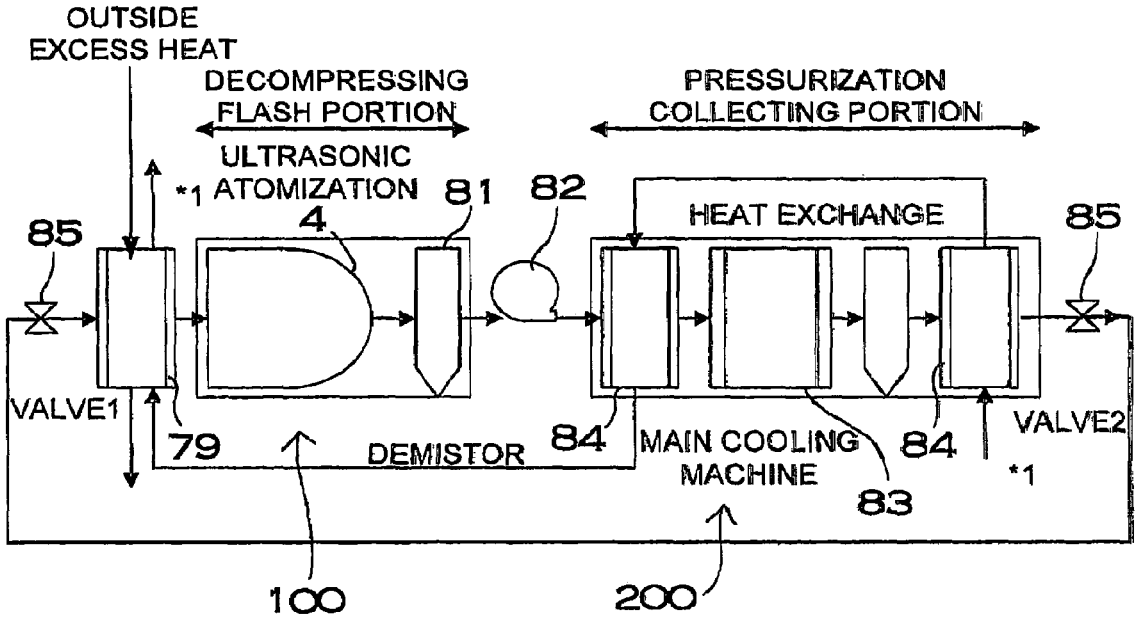
FIG. 20 is a schematic view showing a structure of an apparatus for separating petroleum according to a further example of the present invention.

Furthermore, FIG. 20 shows an apparatus for separating petroleum in which the atomizing chamber 4 is decompressed and the collecting device 200 is pressurized. In this apparatus, the atomizing chamber 4 is decompressed to promote the atomization of the petroleum, and a condensation is efficiently carried out in the collecting device 200 to promote the collection in the same manner as the apparatus shown in FIG. 19. A mixed fluid supplied to the collecting device 200 is adiabatically compressed and generates heat. The generated heat is collected by a heat exchanger and is supplied to the air to be a carrier gas which is to be fed to the atomizing chamber 4, and raises a temperature. The air of the carrier gas to be supplied to the atomizing chamber 4 can raise the temperature, and enhance the atomization efficiency of the petroleum. The reason is that it is possible to raise the temperature of the carrier gas, and promote the atomization itself in the atomization carried out by the ultrasonic vibration. The air of the carrier gas supplied to the atomizing chamber 4 which is decompressed is adiabatically expanded so that the temperature is reduced. For this reason, it is desirable that the adiabatic compression heat of the collecting device 200 should be moved as a heat source for raising the temperature of the air.

The mixed fluid containing the atomized fine particle of the atomized petroleum is caused to pass through the demister 81 to be the first collecting device. The demister 81 serves to cause the atomized fine particle having a comparatively large particle size which is neither vaporized nor changed into an aerosol to mechanically come in contact with the demister 81, and to flocculate and collect the same atomized fine particle. In the apparatus shown in this drawing, the collecting device 200 including the heat exchanger 84 in a multistage is coupled to interpose the main cooling machine 83 between the inflow and discharge sides of the main cooling machine 83 in the same manner as the apparatus shown in FIG. 19. The heat exchanger 84 in a multistage can be thermally moved, and save an energy to operate the apparatus. More specifically, the cold of a vapor phase at the outlet of the main cooling machine 83 is given to the inlet of a pressurizing and collecting portion. The output side of the collecting device 200 is coupled to the atomizing chamber 4 through a control valve 85. The control valves 85 and 85 to be used can be of a spring type but are not restricted. The control valve of the spring type is opened when a pressure is raised to reach a ser pressure. While it is desirable that a pump for moving the carrier gas should be of a diaphragm type or a piston type, and the pump is not restricted.

It is also possible to collect, in an adsorbing device (not shown), the hydrocarbon mixture contained in the carrier gas which finally goes out of the collecting device. The adsorbing device includes an adsorbing tower filled with active carbon, zeolite, silica, a ceramics porous body or the like. The adsorbing device adsorbs and collects a dilute hydrocarbon mixture contained in the carrier gas. While the adsorbing device heats and removes and/or attaches the hydrocarbon mixture which is adsorbed, it is desirable that the same device should be of a swing type. The adsorbing device of the swing type uses a two-tower method, and the removal and/or the attachment and the collection are carried out by one of the adsorbing towers while the other adsorbing tower carries out the adsorption. In the adsorbing device, the adsorbing tower may be of a rotor type and a honeycomb is caused to carry the active carbon, the zeolite, the silica and the ceramics porous body, and they are adsorbed and collected on either side of the center of the rotation of a rotor, and are heated, removed and/or attached and collected on the other side.

Figure 21:
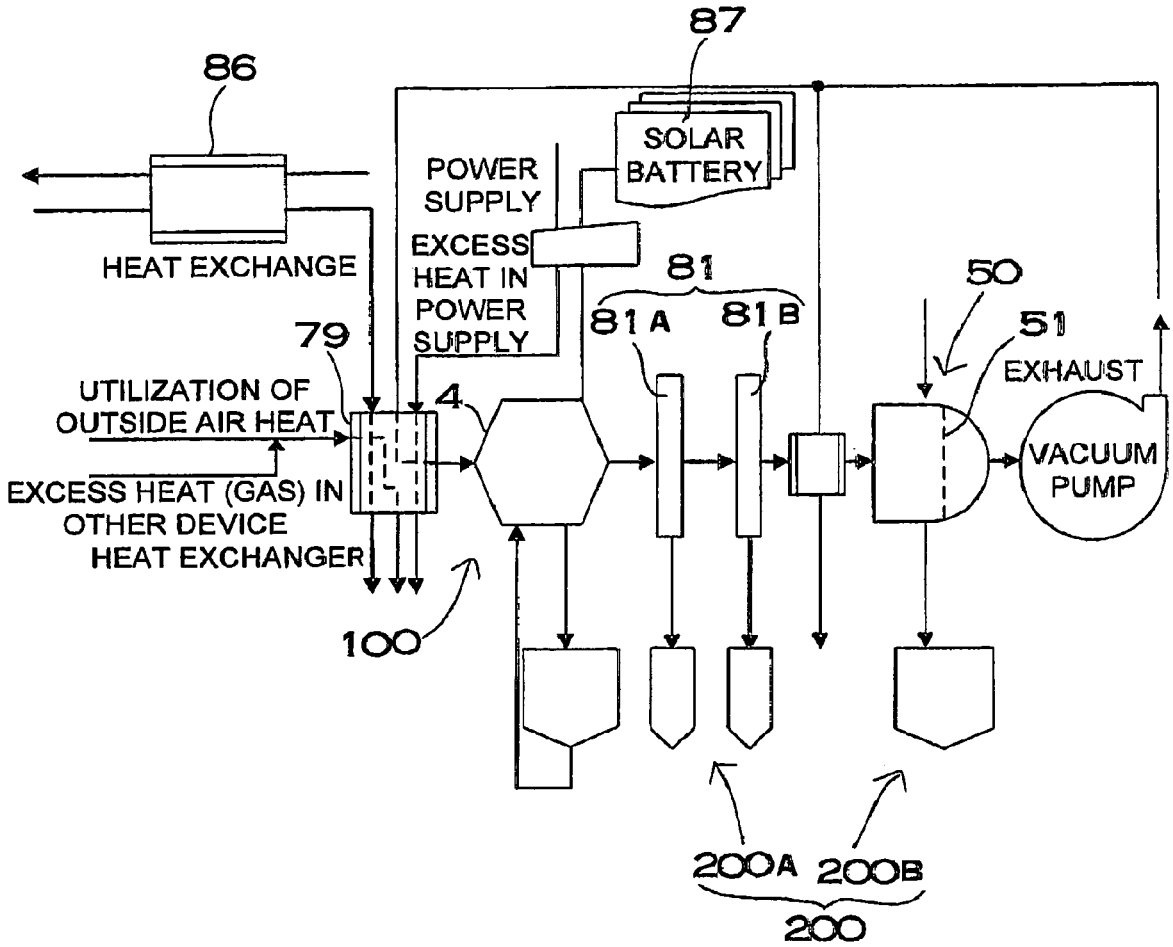
FIG. 21 is a schematic view showing a structure of an apparatus for separating petroleum according to a further example of the present invention.

FIG. 21 shows an apparatus for separating petroleum which is of a type using a molecular sieve film utilizing an air separating film of a zeolite film. This apparatus comprises the air separating machine 50 for separating a hydrocarbon mixture from a mixed fluid. The air separating machine 50 includes a zeolite film as the air transmitting film 51. The zeolite film of the air transmitting film 51 has a thin hole which is smaller than the molecular diameter of the hydrocarbon mixture constituting the petroleum and is larger than the molecular diameters of nitrogen and oxygen which constitute the air to be a carrier gas to be introduced in an atomizing portion. More specifically, the zeolite film is an air transmitting film through which the carrier gas can be transmitted and the hydrocarbon mixture cannot be transmitted. For the air transmitting film, it is also possible to use the silica, the ceramics porous body and the like in place of the zeolite film.

In the apparatus, the outside air heat exchanger 79 is coupled to the inflow side of the atomizing chamber 4. The outside air heat exchanger 79 heats the air to be the carrier gas which is to be supplied to the atomizing chamber 4 by effectively utilizing excessive heat on an outside. In the apparatus shown in the drawing, furthermore, an excess heat exchanger 86 is coupled to the outside air heat exchanger 79. The excess heat exchanger 86 heats the outside air by effectively utilizing excessive heat generated from another device. The outside air heated by the excess heat exchanger 86 heats the air to be the carrier gas which is to be supplied to the atomizing chamber 4 through the outside air heat exchanger 79. The air to be the carrier gas heated by the outside air heat exchanger 79 is supplied to the atomizing chamber 4 so that the atomizing chamber 4 atomizes the petroleum into the atomized fine particle. The atomized fine particle thus obtained is diffused into the carrier gas so as to be a mixed fluid. In this state, the atomized fine particles are partially vaporized or are changed into an aerosol, and are moved toward the collecting device 200. The atomized fine particle which is contained in the mixed fluid and has a comparatively large particle size is collected in mechanical contact by means of the demister 81 to be the first collecting device 200A. In the apparatus shown in the drawing, the demister 81 to be the first collecting device 200A is coupled in two stages. In the demister 81A in a first stage, the petroleum having a larger content of the hydrocarbon mixture having a large number of the carbons (n) is collected as compared with the demister 81B in a second stage. The mixed fluid passing through the demister 81 is supplied to the air separating machine 50 having a molecular sieving effect, that is, the second collecting device 200B. The air separating machine 50 separates only the air from the mixed fluid through the zeolite film of the air transmitting film 51 and discharges the air to the outside. The hydrocarbon mixture which is not transmitted through the zeolite film of the air transmitting film 51 is separated from the air through the air separating machine 50 and is thus collected. In the air separating machine 50, a primary passage side may be pressurized and cooled.

Furthermore, the separating apparatus shown in the drawing uses, as a power supply, a solar battery 87, a fuel cell or a power generated by a wind power. This apparatus does not use a boiler to carry out driving differently from a conventional distilling apparatus. As a result, it is possible to eliminate the discharge nitrogen oxides, sulfur oxides, a floating particle substance or a greenhouse gas. According to this apparatus, moreover, equipment for taking a countermeasure against these toxic substances is not required for each oil refinery. Consequently, it is also possible to obtain the affect of reducing a cost from a total point of view in our country. It is preferable to take a countermeasure against a large scale greenhouse substance or toxic substance such as a thermal power plant, an atomic power plant or the like. Consequently, it is possible to obtain the merit of scale for taking a countermeasure against an environment. In an ultrasonic oscillating circuit, moreover, heat is generated in a rate of several tens %. The heat can be collected to be effectively utilized by raising the temperature of the carrier gas to be supplied to the atomizing chamber 4 or raising the temperature of the petroleum in the atomizing chamber 4.

Figure 22:
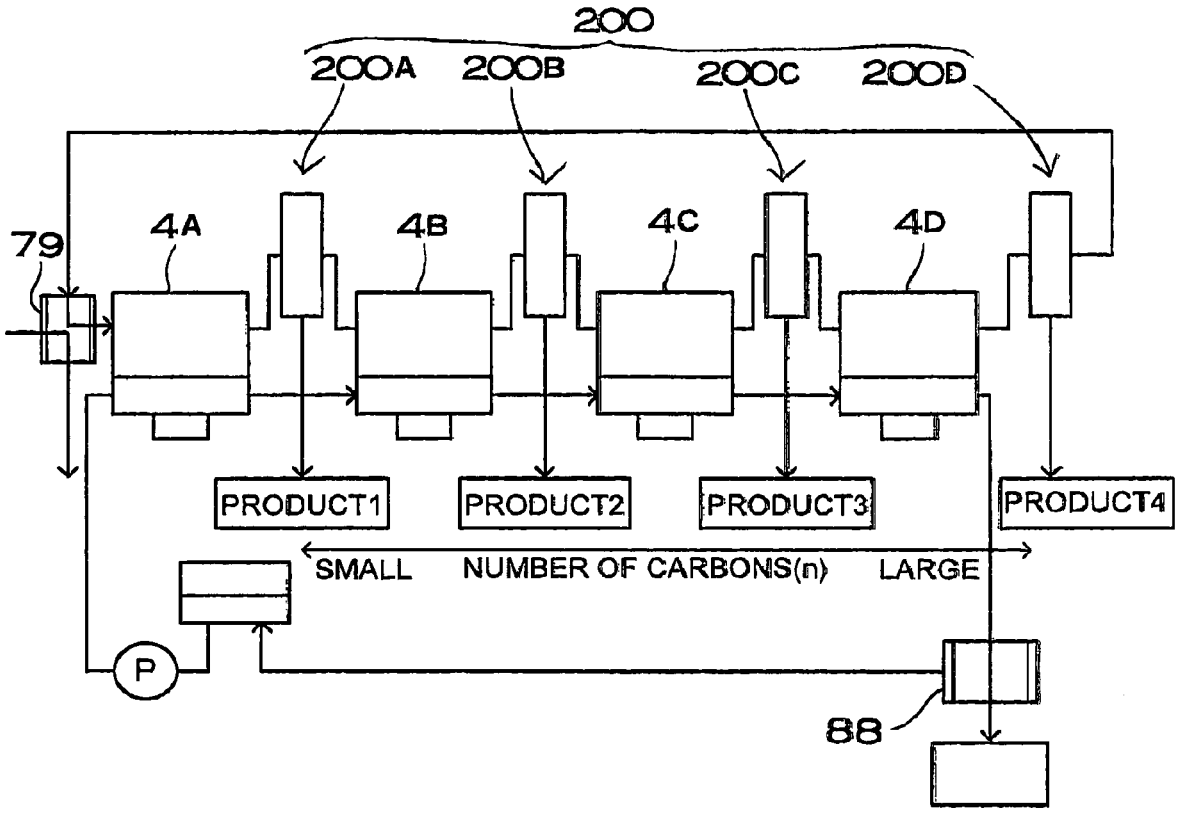
FIG. 22 is a schematic view showing a structure of an apparatus for separating petroleum according to a further example of the present invention.

In an apparatus for separating the petroleum shown in FIG. 22, a plurality of atomizing chambers 4 is coupled in series. In the apparatus shown in this drawing, the atomizing chambers 4 and the collecting devices 200 are coupled in series in four stages, respectively. The petroleum is moved to the first, second, third and fourth atomizing chambers 4 in order. When the petroleum is moved, a hydrocarbon mixture having a small number of the carbons (n) is sequentially separated as an atomized fine particle from the petroleum in the atomizing chamber 4. Accordingly, the petroleum of the atomizing chamber 4 in a former stage has a larger content of the hydrocarbon mixture having the small number of the carbons (n) as compared with the petroleum of the atomizing chamber 4 in a latter stage. The temperature of the petroleum in the atomizing chamber 4 is set to be lower in the former stage than the latter stage. The petroleum of the atomizing chamber 4 in the latter stage has a larger content of the hydrocarbon mixture having a large number of the carbons (n) as compared with the petroleum of the atomizing chamber 4 in the former stage. For this reason, the temperature of the petroleum is gradually raised to increase the efficiency of the atomization into the atomized fine particle. By reducing the temperature of the petroleum of the atomizing chamber 4 in the former stage, moreover, it is possible to separate the petroleum having a large content of the hydrocarbon mixture having a small number of the carbons (n) in the atomizing chamber 4 and the collecting device 200 in the former stage. The collecting device 200 cools the mixed fluid, and separates, from the air, the hydrocarbon mixture contained in the mixed fluid.

The separating apparatus in this drawing supplies a petroleum material at an ordinary temperature to the first atomizing chamber 4A. The first atomizing chamber 4A sets the temperature of the petroleum to be the lowest as compared with the temperature of the petroleum in each of the other atomizing chambers 4, and carries out an atomization into an atomized fine particle by an ultrasonic vibration. The mixed fluid containing the atomized fine particle has a large content of the hydrocarbon mixture having the small number of the carbons (n). The petroleum having the large content of the hydrocarbon mixture having the small number of the carbons (n) is separated from the air and is collected in the first collecting device 200A. The residual petroleum from which the petroleum having the large content of the hydrocarbon mixture having the small number of the carbons (n) is separated in the first atomizing chamber 4A is supplied to the second atomizing chamber 4B. The petroleum in the second atomizing chamber 4B has a large content of the hydrocarbon mixture having a larger number of the carbons (n) than that of the petroleum in the first atomizing chamber 4A. For this reason, the petroleum in the second atomizing chamber 4B is heated to have a higher temperature than the petroleum in the first atomizing chamber 4A. In the second atomizing chamber 4B, the temperature of the petroleum is raised, and generates an atomized fine particle by an ultrasonic vibration. The atomized fine particle generated in the second atomizing chamber 4B has a high content ratio of the hydrocarbon mixture having a larger number of the carbons (n) as compared with the atomized fine particle generated in the first atomizing chamber 4A. The mixed fluid passing through the first collecting device 200A is supplied to the second atomizing chamber 4B. The mixed fluid generated in the second atomizing chamber 4B is supplied to the second collecting device 200B. The second collecting device 200B collects the atomized fine particle generated in the second atomizing chamber 4B. A part of the atomized fine particles generated in the first atomizing chamber 4A pass through the first collecting device 200A and are collected in the second collecting device 200B. The hydrocarbon mixture to be collected in the second collecting device 200B becomes petroleum having a large content of the hydrocarbon mixture having a larger number of the carbons (n) as compared with the hydrocarbon mixture to be collected in the first collecting device 200A. The residual petroleum from which the hydrocarbon mixture is separated in the second atomizing chamber 4B is supplied to the third atomizing chamber 4C. In the same manner, the residual petroleum from which the hydrocarbon mixture is separated in the third atomizing chamber 4C is supplied to the fourth atomizing chamber 4D. The mixed fluid passes through the first collecting device 200A, the second collecting device 200B, the third collecting device 200C, and the fourth collecting device 200D, and the petroleum having a large content of the hydrocarbon mixture having a large number of the hydrocarbons (n) is gradually separated and collected in the first to fourth collecting devices 200. As described above, it is possible to gradually raise the temperature of the petroleum in order, and to separate the petroleum having a large content of the hydrocarbon mixture having a large number of the hydrocarbons (n) gradually.

In the apparatus shown in the drawing, the heat of the residual oil left finally is collected in a residual oil heat exchanger 88. In the examples described above, the petroleum in the first atomizing chamber 4A is not heated but can also be heated. Moreover, it is possible to insulate the outside of the atomizing chamber 4, and to reduce the use of an energy in the whole apparatus as greatly as possible. In the apparatuses described above, the petroleum is separated in the contents of the hydrocarbon mixtures having different numbers of the carbons (n). Consequently the apparatuses are suitable for separating a crude oil into a light oil, kerosene, naphtha or the like.

Tables 1 to 3 show components before and after a separation in gasoline separated by the separating method according to the present invention. This test was carried out by putting gasoline on the market in a vessel, and irradiating an ultrasonic wave of 2.4 MHz and 16 W from below a liquid surface to atomize petroleum into an atomized fine particle at an initial temperature of 28° C., so that the test measures the components of the petroleum before and after the ultrasonic atomization.

In the separating method, 20 litters/minute of air is introduced as a carrier gas into the atomizing surface of the atomizing chamber 4, and the temperature of the introduced air is set to be 23° C. A time required for the atomization is set to be 15 minutes. For a sulfur portion, a microcurrent titration type oxidation process defined in JIS K 2541-2 is used. PONA and a hydrocarbon component in the gasoline are subjected to a total component test by a gas chromatography process defined in the JIS K 2536-2, and an addition is carried out for each carbon chain length and type.

TABLE 1

| Carbon chain length before atomizing treatment | | Paraffin | Olefin | Naphthene | Aromatic |
|---|---|---|---|---|---|
| 3 | V/V % | 0.1 | 0.0 | 0.0 | 0.0 |
| 4 | V/V % | 3.7 | 1.8 | 0.0 | 0.0 |
| 5 | V/V % | 15.1 | 4.4 | 0.3 | 0.0 |
| 6 | V/V % | 13.7 | 2.7 | 1.1 | 0.3 |
| 7 | V/V % | 8.1 | 3.0 | 1.7 | 8.7 |
| 8 | V/V % | 5.0 | 1.7 | 1.3 | 3.5 |
| 9 | V/V % | 1.8 | 0.8 | 0.9 | 10.1 |
| 10 | V/V % | 1.5 | 0.5 | 0.2 | 4.5 |
| 11 | V/V % | 0.9 | 0.4 | 0.1 | 1.4 |
| 12 | V/V % | 0.4 | 0.1 | 0.0 | 0.2 |
| 13 | V/V % | 0.0 | 0.0 | 0.0 | 0.0 |
| Total | V/V % | 50.3 | 15.4 | 5.6 | 28.7 |
| Sulfur portion | ppm | | | 73.0 | |

TABLE 2

| Carbon chain length after atomizing treatment | | Paraffin | Olefin | Naphthene | Aromatic |
|---|---|---|---|---|---|
| 3 | V/V % | 0.0 | 0.0 | 0.0 | 0.0 |
| 4 | V/V % | 0.1 | 0.1 | 0.0 | 0.0 |
| 5 | V/V % | 5.5 | 2.0 | 0.2 | 0.0 |
| 6 | V/V % | 11.9 | 2.6 | 1.1 | 0.3 |
| 7 | V/V % | 9.6 | 3.6 | 2.1 | 11.2 |
| 8 | V/V % | 6.7 | 2.3 | 1.8 | 4.9 |
| 9 | V/V % | 2.5 | 1.0 | 1.2 | 14.5 |
| 10 | V/V % | 2.0 | 0.7 | 0.3 | 6.5 |
| 11 | V/V % | 1.2 | 0.5 | 0.1 | 2.2 |
| 12 | V/V % | 0.6 | 0.2 | 0.0 | 0.4 |
| 13 | V/V % | 0.1 | 0.0 | 0.0 | 0.0 |
| Total | V/V % | 40.2 | 13.0 | 6.8 | 40.0 |
| Sulfur portion | ppm | | | 97.0 | |

TABLE 3

| Concentration in vapor phase in atomizing portion | | Paraffin | Olefin | Naphthene | Aromatic |
|---|---|---|---|---|---|
| 3 | V/V % | 0.3 | 0.0 | 0.0 | 0.0 |
| 4 | V/V % | 11.7 | 5.6 | 0.0 | 0.0 |
| 5 | V/V % | 36.4 | 9.7 | 0.5 | 0.0 |
| 6 | V/V % | 17.7 | 2.9 | 1.1 | 0.3 |
| 7 | V/V % | 4.8 | 1.7 | 0.8 | 3.1 |
| 8 | V/V % | 1.2 | 0.4 | 0.2 | 0.4 |
| 9 | V/V % | 0.2 | 0.4 | 0.2 | 0.3 |
| 10 | V/V % | 0.4 | 0.1 | 0.0 | 0.1 |
| 11 | V/V % | 0.2 | 0.2 | 0.1 | −0.4 |

TABLE 3-continued

| Concentration in vapor phase in atomizing portion | | Paraffin | Olefin | Naphthene | Aromatic |
|---|---|---|---|---|---|
| 12 | V/V % | 0.0 | −0.1 | 0.0 | −0.2 |
| 13 | V/V % | −0.2 | 0.0 | 0.0 | 0.0 |
| Total | V/V % | 72.7 | 20.7 | 2.9 | 3.6 |
| Sulfur portion | ppm | | | 19.7 | |

"Data before an atomizing treatment" and "data after the atomizing treatment" indicate the result of the measurement for the gasoline before and after the ultrasonic atomizing treatment. "Data on the concentration in the vapor phase in the atomizing portion" is obtained by a calculation based on a material balance depending on the weight and composition of the gasoline before and after the ultrasonic atomization. At this time, it can be supposed that cracking is rarely generated due to a cavitation in consideration of the conditions of the generation of an ultrasonic wave. For this reason, the depolymerization of a petroleum component is not caused.

Figure 23:
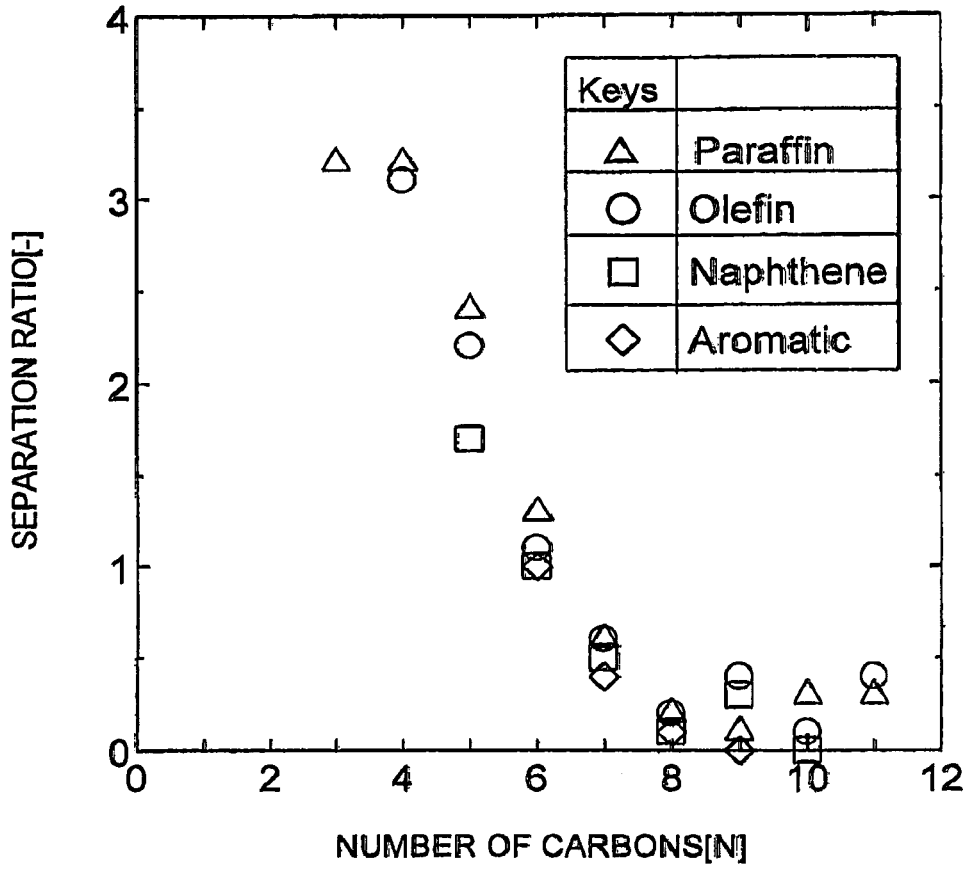
FIG. 23 is a chart showing the separation ratio of each component concentration of each carbon chain length in the vapor phase of an atomizing portion before an atomizing treatment.

FIG. 23 shows a change ratio of each component concentration of each carbon chain length in the "concentration in the vapor phase in the atomizing portion" to the concentration of each component of each carbon chain length in "before the atomizing treatment", that is, a separation ratio. It is apparent that a ratio of an original petroleum component remaining in a solution is equal to a ratio of a distribution in a vapor phase when a separation degree is 1, the component is easily moved as an atomized fine particle to a mixed fluid when the separation degree exceeds 1, and the component is easily accumulated on the residual petroleum side when the separation degree is equal to or lower than 1. As is apparent from this drawing, the component having a smaller number of the carbons (n) and a smaller carbon chain length is easily moved as the atomized fine particle to the mixed fluid.

In comparison of the component compositions in "the concentration in the vapor phase in the atomizing portion" and "before the atomizing treatment", moreover, the rates of paraffins and olefins in the vapor phase are increased and the concentrations of the naphthenes and aromatics in the residual oil are increased. The separating method according to the present invention can greatly change the composition of the petroleum as described above. Moreover, a consumed energy was measured. As a result, also in case of a gasoline separation test, the total value of a vibration energy (16 J/s) of an ultrasonic wave and a vapor-phase enthalpy decrease (3.4 J/s) is lower than a vaporization energy (52 J/s) of the gasoline so that the ultrasonic atomizing separation of the gasoline can be carried out by energy saving.

In a comparison of the concentrations of sulfur in "before the atomizing treatment" and "the concentration in the vapor phase in the atomization", simultaneously, it is apparent that they are reduced to be approximately ⅓. This implies that the concentration of the sulfur in the gasoline can be reduced to be 10 ppm or less by the atomizing treatment in two stages.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims. This application is based on Application No. 2004-232,771 filed in Japan on Aug. 9, 2004, and Application No. 2005-43,275 filed in Japan on Feb. 18, 2005, the contents of which are incorporated hereinto by reference.

What is claimed is:

1. A method of separating petroleum into hydrocarbon mixtures having different components, comprising:

an atomizing step of ultrasonically vibrating the petroleum to discharge and atomize the petroleum in a state of an atomized fine particle floating in a carrier gas, and carrying out a separation into a mixed fluid containing the atomized fine particle and the carrier gas and residual petroleum which is not atomized; and a collecting step of separating and collecting the hydrocarbon mixture from the mixed fluid obtained at the atomizing step, wherein the petroleum is separated into the residual petroleum and the mixed fluid at the atomizing step, and the mixed fluid is collected at the collecting step to separate the petroleum into hydrocarbon mixtures having different components.

2. The method of separating petroleum according to claim 1, wherein a crude oil is used for the petroleum to be separated and gasoline, a light oil and kerosene are separated from the crude oil.

3. The method of separating petroleum according to claim 1, wherein gasoline is used for the petroleum to be separated, and is refined.

4. The method of separating petroleum according to claim 3, wherein the gasoline is separated into residual petroleum and a mixed fluid at the atomizing step to reduce a reid vapor pressure of the gasoline to be the residual petroleum.

5. The method of separating petroleum according to claim 1, wherein the petroleum is separated into petroleum containing hydrocarbon mixtures having different numbers of carbons (n) at the atomizing step.

6. The method of separating petroleum according to claim 1, wherein the petroleum is separated into petroleum containing hydrocarbon mixtures having different numbers of carbons (n) at the collecting step.

7. The method of separating petroleum according to claim 1, wherein the petroleum is heated and is atomized at the atomizing step.

8. The method of separating petroleum according to claim 1, wherein the carrier gas is air.

9. An apparatus for separating petroleum into hydrocarbon mixtures having different components, comprising:

an atomizing device for ultrasonically vibrating the petroleum and discharging and atomizing the petroleum in a state of an atomized fine particle floating in a carrier gas, and carrying out a separation into a mixed fluid containing the atomized fine particle and the carrier gas and residual petroleum which is not atomized; and a collecting device for separating and collecting the hydrocarbon mixture from the mixed fluid obtained in the atomizing device, wherein the petroleum is separated into the residual petroleum and the mixed fluid by the atomizing device and the mixed fluid is collected by the collecting device so that the petroleum is separated into hydrocarbon mixtures having different components.

10. The apparatus for separating petroleum according to claim 9, wherein the atomizing device includes an atomizing chamber for supplying the petroleum and an atomizing machine for atomizing the petroleum in the atomizing chamber into the atomized fine particle by the ultrasonic vibration.

11. The apparatus for separating petroleum according to claim 9, wherein the atomizing device includes an ultrasonic vibrator, the ultrasonic vibrator ultrasonically vibrating the petroleum and atomizing the petroleum into the atomized fine particle.

12. The apparatus for separating petroleum according to claim 9, further comprising a heater for the petroleum to be supplied to the atomizing device.

13. The apparatus for separating petroleum according to claim 12, further comprising a temperature sensor for detecting a temperature of the petroleum stored in the atomizing chamber, the heater being controlled by means of the temperature sensor to hold the temperature of the petroleum to be a set temperature.

14. The apparatus for separating petroleum according to claim 9, wherein the atomizing device includes an atomizing chamber for supplying the petroleum and an atomizing machine for atomizing the petroleum in the atomizing chamber into the atomized fine particle by a plurality of ultrasonic vibrators.

15. The apparatus for separating petroleum according to claim 14, wherein the ultrasonic vibrators are fixed to a removable plate, the removable plate is attached to the atomizing chamber so as to be freely removed and attached in a waterproof structure, the removable plate is attached to a casing of the atomizing chamber, and each of the ultrasonic vibrators ultrasonically vibrates the petroleum in the atomizing chamber.

16. The apparatus for separating petroleum according to claim 9, wherein the atomizing machine is ultrasonically vibrated at a frequency of 1 MHz or more, thereby atomizing the petroleum.

17. The apparatus for separating petroleum according to claim 9, wherein the collecting device cools the mixed fluid containing the atomized fine particle and the carrier gas, thereby collecting the hydrocarbon mixture.

* * * * *